United States Patent [19]

Barrett

[11] Patent Number: 4,788,701

[45] Date of Patent: Nov. 29, 1988

[54] IRRADIATORS FOR BULK, PALLETIZED AND/OR PACKAGED MATERIALS

[76] Inventor: Lawrence G. Barrett, 3223 Downing Dr., Lynchburg, Va. 24503

[21] Appl. No.: 701,310

[22] Filed: Feb. 13, 1985

[51] Int. Cl.[4] ..... G21K 5/10

[52] U.S. Cl. ..... 378/69; 378/68; 250/453.1; 250/454.1; 250/455.1

[58] Field of Search ..... 378/66, 67, 68, 69; 376/208, 212, 157, 159, 341; 99/451, 485; 250/453.1, 454.1, 455.1

[56] References Cited

U.S. PATENT DOCUMENTS

| | | | |
|---|---|---|---|
| 1,856,084 | 5/1932 | Smith | 99/451 |
| 3,177,121 | 4/1965 | Horowitz et al. | 376/341 |
| 3,519,817 | 7/1970 | Brunner | 378/67 |
| 3,604,934 | 9/1971 | Melillo et al. | 378/68 |
| 4,172,019 | 10/1979 | Woodbridge | 378/67 |

*Primary Examiner*—Janice A. Howell
*Assistant Examiner*—David P. Porta
*Attorney, Agent, or Firm*—Diller, Ramik & Wight

[57] ABSTRACT

The disclosure is directed to modular irradiators for irradiating bulk and/or palletized materials characterized by each bulk material irradiator including a self-contained conveyor unit including a tube through which bulk material is fed vertically downwardly into an interior chamber, a spiral screw which during rotation thereof conveys the bulk material upwardly through the interior chamber, and gamma ray source elements which emit gamma rays to irradiate the bulk material during its downward and upward movement through the interior chamber. A conveying system is also positioned outwardly of the gamma ray source elements for effecting spiral and reciprocal/rotary movement of palletized and/or packaged material relative to the gamma ray source elements. The modular irradiators and gamma ray source elements are supported upon a base and the base, modular irradiators and gamma ray source elements include interdigitated projections and openings which function to accurately locate the source elements relative to the modular irradiators, change the distance therebetween to vary dosage requirements, and adapt the irradiators for alternative or joint use of Cobalt-60 in racks and/or Cesium-137 in tubes.

127 Claims, 11 Drawing Sheets

FIG.2
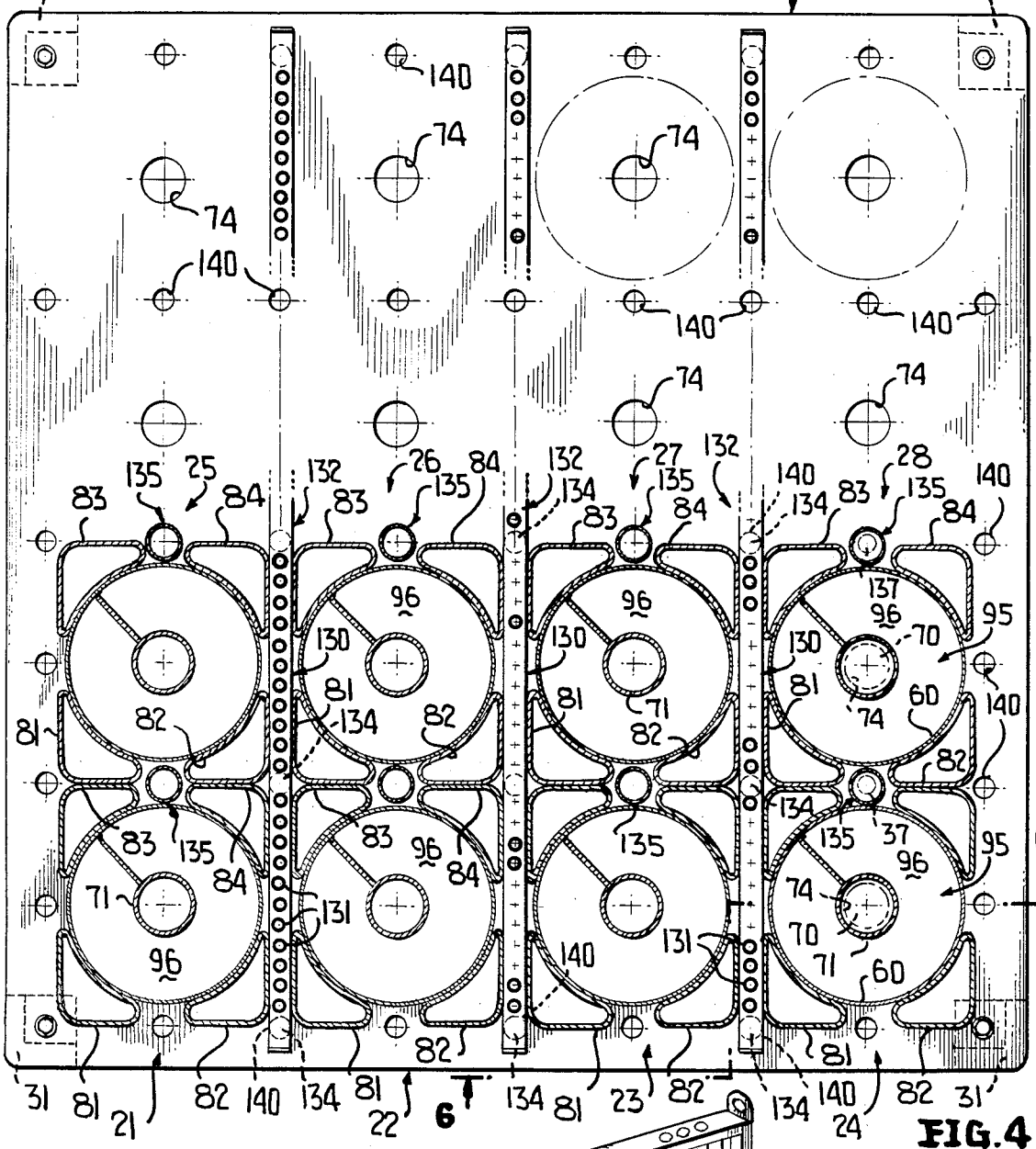
FIG.3
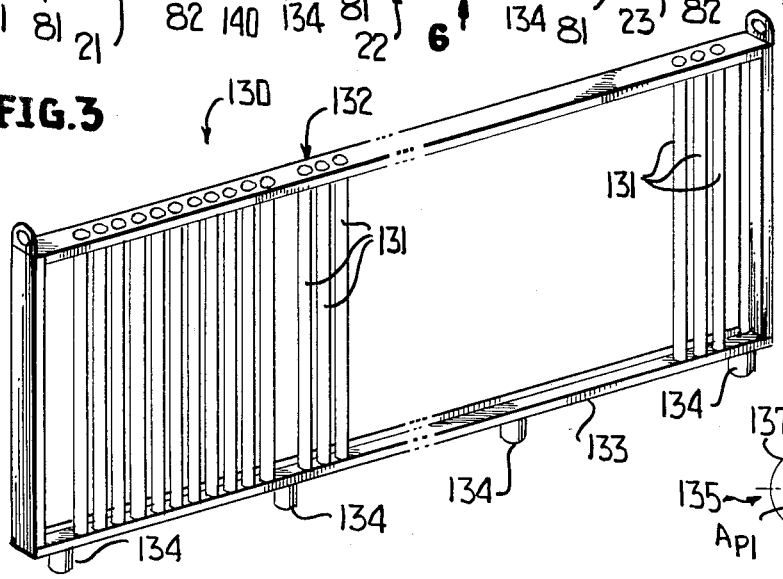
FIG.4
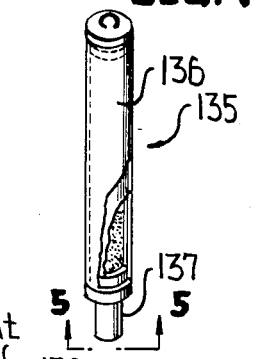
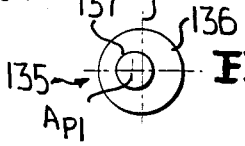
FIG.5

SEE FIG.13

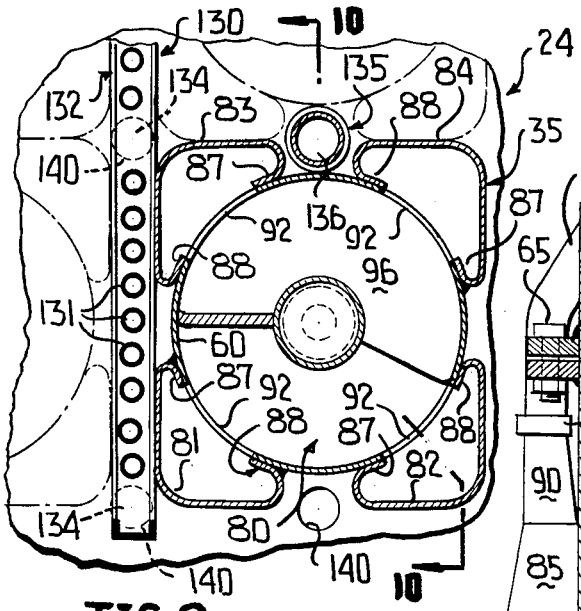
FIG. 9
FIG. 13
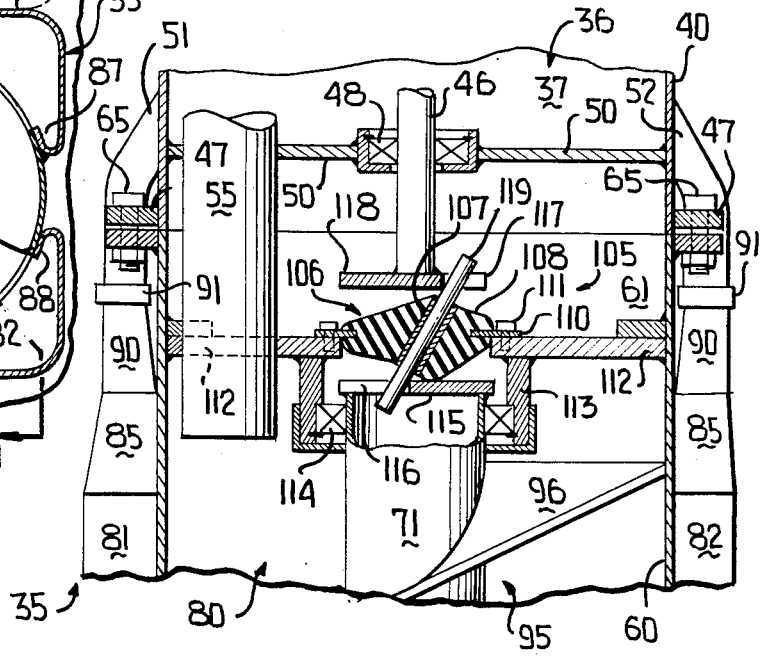
FIG. 10
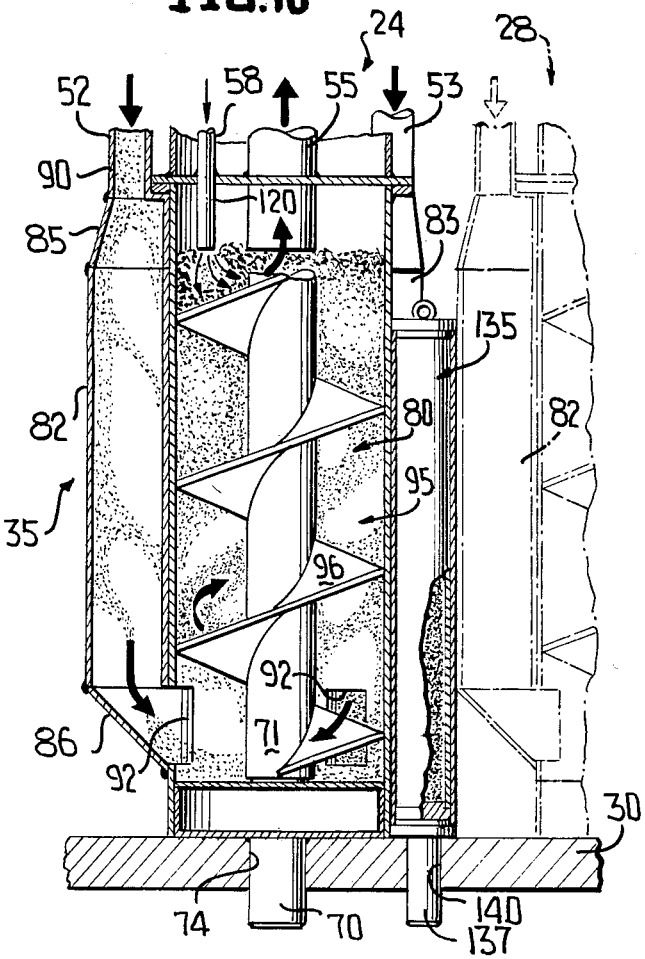
FIG. 11
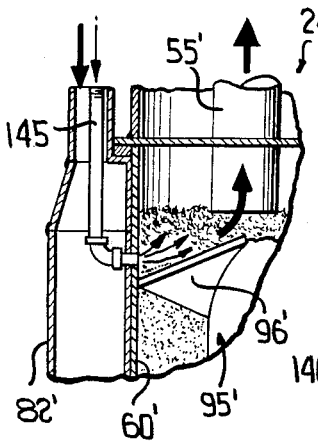
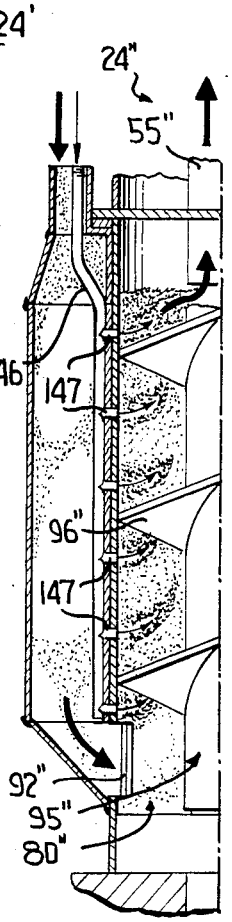
FIG. 12

FIG.21
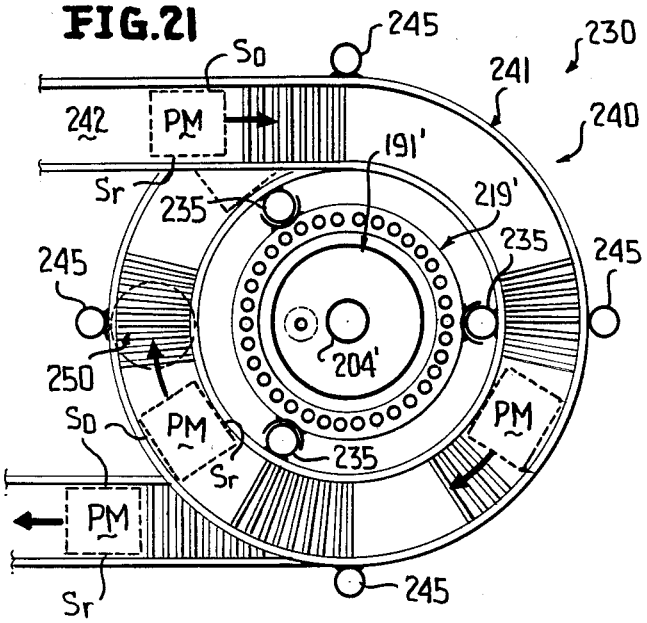
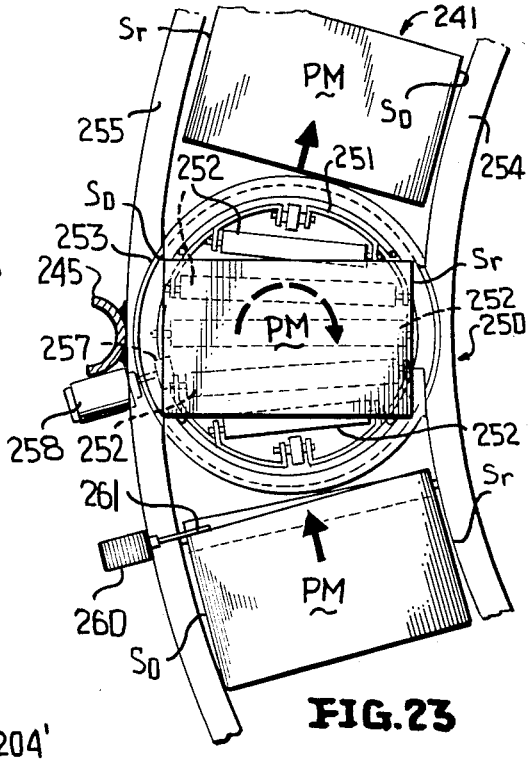
FIG.23
FIG.22
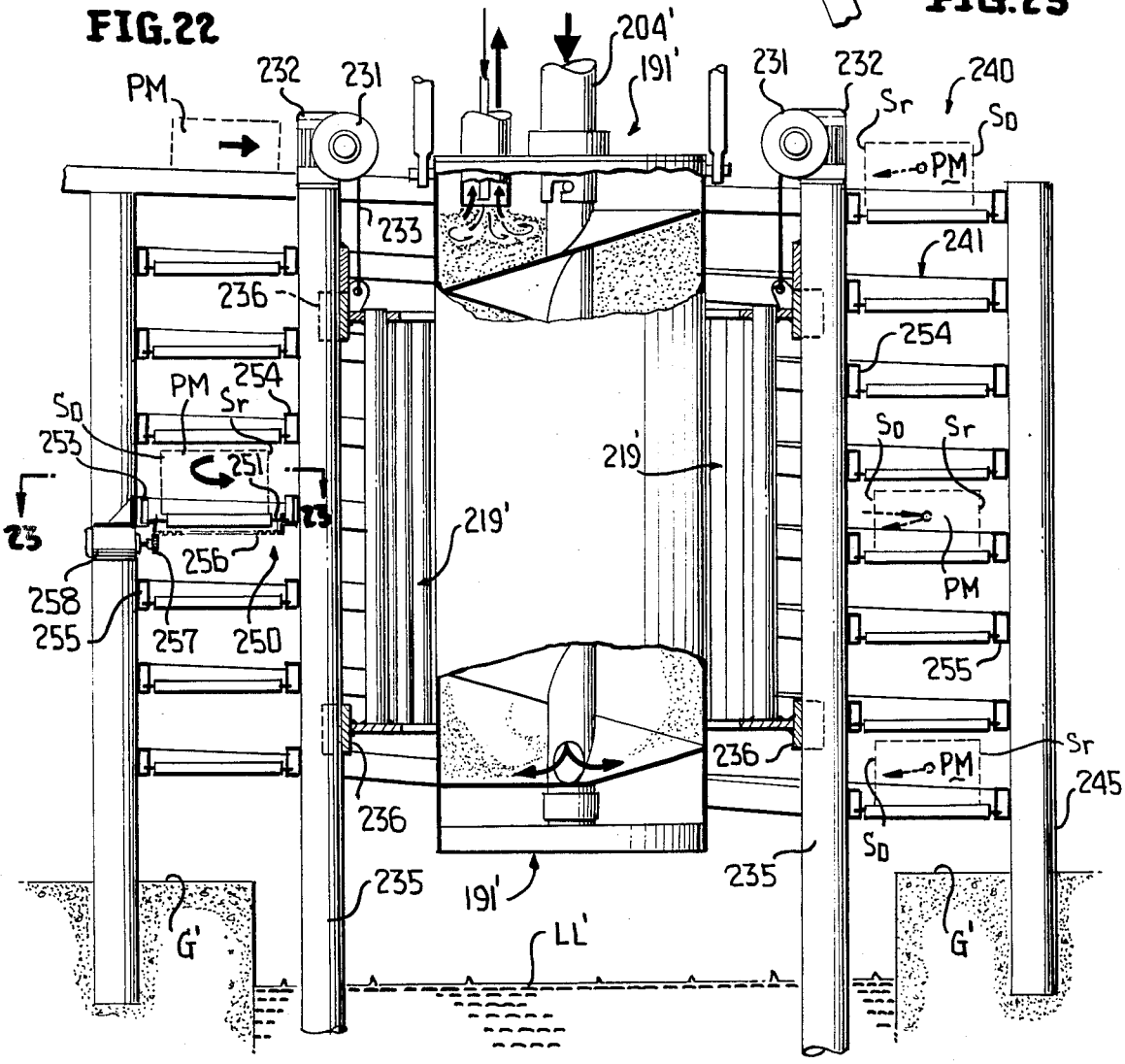

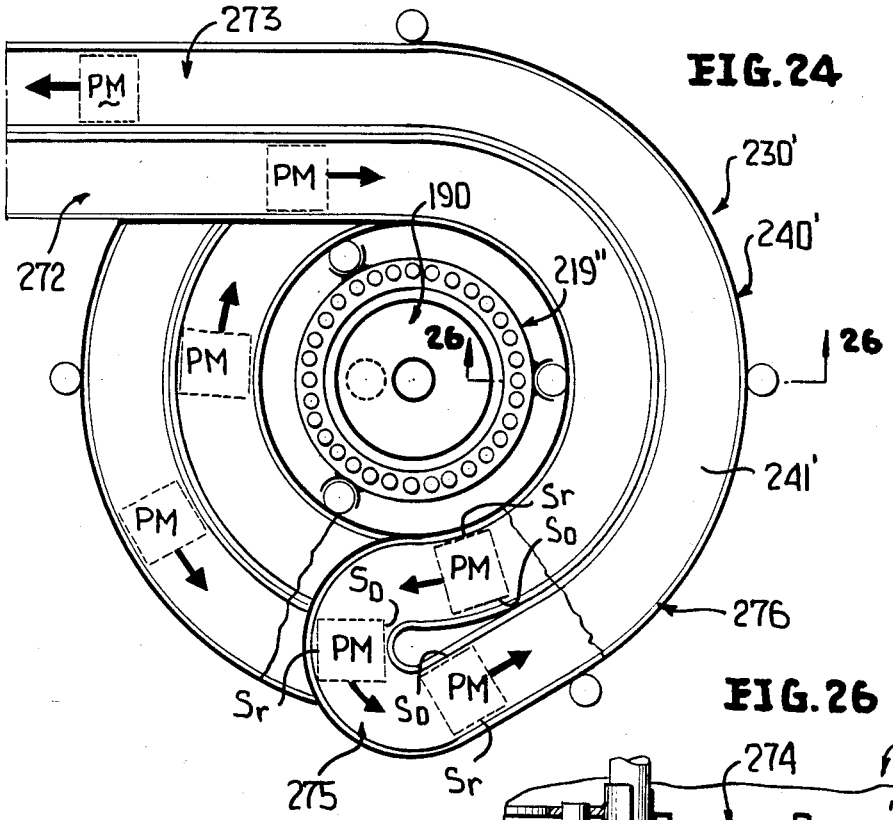
FIG.24
FIG.26
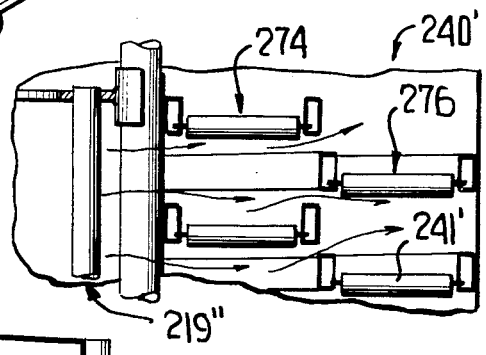
FIG.25
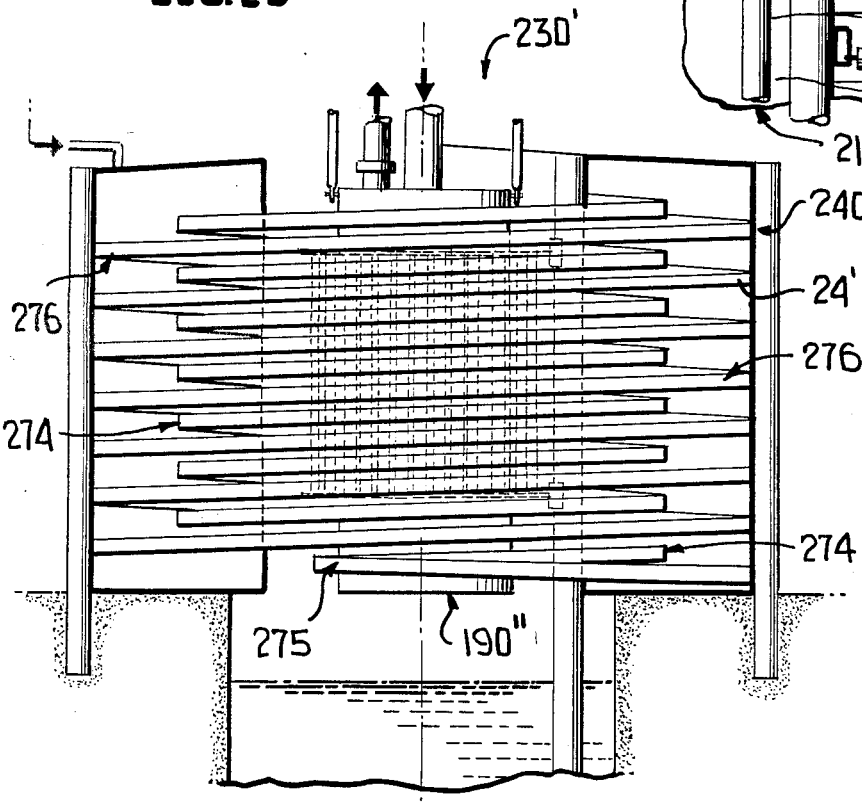

IRRADIATORS FOR BULK, PALLETIZED AND/OR PACKAGED MATERIALS

Though it is possible to develop an irradiator system which would embrace the use of radioactive or gamma ray sources of a wide range of isotopes and a variety of different geometrical configurations, the present practicality and availability of two common gamma ray source elements place constraints and restrictions upon innovations in irradiation systems or techniques. Thus, although it is recognized that in due course over the years other types of radioactive sources may become available, the history of the development of irradiators demonstrates that this is not likely to be the case within the very near future. Thus, within the past thirty years there still remains just two standard radioactive gamma source materials practically available, and they are Cobalt-60 and Cesium-137.

Cobalt-60 source elements are only available in the United States from two different suppliers, but they are fairly standardized cylindrical rod type source elements approximately 9/16" in diameter and from 8 to 16 inches long. The length can be increased by using multiples of Cobalt-60 source elements arranged in line with each other.

The only practical Cesium-137 source available for use in production type irradiators is that which is currently available from the Department of Energy through their WESF capsules. These units are fairly large, approximating 2⅝ inches in diameter and 20 inches long. These Cesium-137 source elements are a product of waste storage programs and provide an activity level of 60 to 70 thousand curies in each unit. If properly used the efficiency of these Cesium-137 sources, in terms of energy actually deposited in the materials being irradiated, is only one-fifth to one-seventh that which may be obtained from the same number of curies of Cobalt-60. Cobalt-60 emits two gamma rays per disintegration with a total energy of 2.5 MEV. This is to be compared with a single gamma ray per disintegration from Cesium-137 with an energy of 0.66 MEV and only in 85 percent of the disintegrations is one of these gamma rays emitted. Cobalt-60 has a half-life of approximately 5.27 years and Cesium-137 a half-life of thirty years.

The latter comparative criteria must be carefully considered in creating an overall irradiator system which can utilize both Cesium-137 and Cobalt-60. Obviously, the criteria for the irradiation of any bulk granular or powdered material through an irradiator utilizing either Cesium-137 or Cobalt-60 radioisotopic sources is that of maintaining a relatively low maximum to minimum dose ration of the absorbed radiation doses throughout the material being irradiated. W th this criteria in mind and recognizing the differences in the present available gamma ray sources (Cobalt-60 and Cesium-137) the present invention is directed to a novel irradiator system which can utilize either or both radioisotopic sources and can be utilized to irradiate bulk material, such as wheat, grain, flour, etc. packaged or palletized material, such as crates of oranges, apples, etc., or simultaneously irradiate both bulk and packaged or palletized materials.

The present invention includes an irradiation system characterized by a minimum of two passes of bulk, granular or powdered material through the irradiator to optimize utilization of the radioactive source elements.

The overall irradiator system is designed as a plurality of individual modular irradiators collectively placed into a production line with each other and an operating mill which may, for example, grind or mill wheat or other grain. The irradiator system can be used to irradiate the grain itself or the milled flour produced from the grain, and the degree of irradiation can be regulated by, for example, conveying the bulk material through but a single modular irradiator to subject the bulk material to a two-pass irradiation prior to shipment or storage, or instead of the latter, the irradiated bulk material can be conveyed through a second or succeeding modular irradiators to effect further irradiation prior to utilization.

The concept of modular two-pass irradiators in a sophisticated conveying and control system creates a tremendous number of operative possibilities and advantages from a throughput standpoint, but efficiency of the radioactive sources tremendously increased in the utilization thereof and down time can be virtually eliminated when the modular irradiation concept is utilized in conjunction with a sophisticated conveying system. As an example, assuming four individual modular irradiators or irradiator modules of the present invention are interconnected with each other and an operating mill through an appropriate conveying system, it is possible for bulk material, such as grain from the mill, to be conveyed downwardly into and spirally upwardly out of an irradiation zone established by Cobalt-60 and/or Cesium-137 source elements associated with the first modular irradiator. The irradiated material from the first modular irradiator can simply be conveyed to a storage facility but if further irradiation is desired, the output from the first modular irradiator is simply appropriately valved to the input side of a second modular irradiator. The use of the system for highly viscous fluid materials may be affected best by the utilization of a screw type conveyor feeding in a downward direction and then coupled directly to another screw conveyor and another modular unit and feeding in an upward direction. Such a unit could be arranged as a double screw modular unit and inserted in the same manner as described for the singular units in the base system. The once irradiated granular material similarly passes downwardly and then spirally upwardly through the irradiation zone of the second modular irradiator after which its output can in turn be conveyed to a storage facility or in turn directed to yet another modular irradiator for further irradiation. Thus, while speed through the individual modular irradiator can be controlled to vary the irradiation dosage as the bulk material is conveyed therethrough, the very fact that more than an single modular irradiator is utilized serves to add highly desirable versatility to the overall irradiator system.

The same irradiator system can be valved for example, to bypass the second modular irradiator and transfer the bulk material from the first modular irradiator to a third modular irradiator. This is a highly desirable characteristic if, for example, the total dosage desired would be achieved by passing the bulk material through the first andthird modular irradiators but would not be achieved if the same bulk material were passed through the first and second modular irradiators due to, for example, different activity levels of the radioactive sources at the three modular irradiators. This would not be an unusual situation since the dosage would not be necessarily uniform in the irradiation zone of each modular irradiator because of such factors as the divergence of the type of source material thereat, the age of the particular source elements, etc. Thus, if the overall irradiator system included sixteen modular irradiators in an equally spaced four by four geometric configuration, the irradiation dosage at each modular irradiator could be different and by having the capability of selecting any pair (or more) of modular irradiators it is possible to vary the irradiation dose without, for example, changing the throughput speeds, adding or removing radioactive source elements, etc.

The same modular irradiator system also permits any one (or more) modular irradiators to be removed from the system without adversely affecting the throughput. For example, if a particular material were being irradiated through the first and second modular irradiators mentioned in the earlier example, and the second modular irradiator became defective for whatever purpose, the conveying system is so valved to simply transfer the output from the first modular conveyor to another modular conveyor. The second modular conveyor is simply automatically cut-off at the same time and there is virtually no loss of through-put during this changeover. Obviously, the defective (second) modular irradiator of this example can then simply be removed from the overall irradiator system, repaired, replaced and thereafter utilized as desired.

In further accordance with the present invention the modular irradiators are preferably designed for use in a pool-type irradiator system using water as a radiation shield for personnel. However, the same irradiator system can as well be utilized above-ground with concrete shielding, although a pool type irradiator system is preferable because of lower construction costs and ease of source element changes. If, for example, it is desired to irradiate grain at a mill, the pool-type irradiator system is merely located adjacent and connected to pre-existing transfer lines of the mill, and this can be done at very low expense. Thus, the major cost involved in conjunction with pre-existing mills is simply that of installing the pool-type irradiator system and tying in a conveyor mechanism for delivering the grain from the mill to the irradiation system and from the latter to existing storage granaries, trucks, barges or railroad cars. The only specific requirements placed upon the pool-type irradiator system is that of each modular irradiator being water tight, and in accordance with the present invention this requirement poses no severe problem.

In keeping with the foregoing, a primary object of this invention is to provide a novel irradiator system of the type described wherein each modular irradiator thereof includes a generally upright cylindrical wall defining an interior chamber, a first conveyor for directing material generally downwardly of the cylindrical wall, a second conveyor for directing material generally upwardly and interiorly of the cylindrical wall, the first conveyor being a substantially vertical tube through which the material descends, the second conveyor being a screw for elevating the material, and a plurality of gamma ray source means for subjecting the conveyed material to gamma rays during the movement of the material by the first and second conveyors.

Still another object of this invention is to provide a novel modular irradiator of the type last described including a base upon which one or a plurality of generally identical modular irradiators and associated gamma ray sources are supported, the base including a plurality of openings, the modular irradiators and the gamma ray sources each having a plurality of projections, the projections being radially offset from longitudinal axes of the modular irradiators and the gamma ray sources, and the projections being adapted to be received in the openings of the bases and rotated relative thereto for varying the spatial relationships between the gamma ray sources and the modular irradiators to thereby selectively regulate or vary the dosage requirements of the material which is to be irradiated during its movement by the first and second conveyors.

A further object of this invention is to provide a novel irradiator system wherein the gamma ray sources are selectively either individual cylindrical gamma ray source elements or a single rack housing a plurality of individual cylindrical gamma ray source elements, and the latter each include projections for receipt into the base openings so that either or both can be selectively located with respect one or more modular irradiators of the overall system.

Another object of this invention is to provide a novel modular irradiator system and individual modular irradiators therefor as aforesaid wherein the interior chamber of each modular irradiator is liquid tight to adapt to the same for immersion in an irradiator water pool of a pool-type irradiator system, a screw in the interior chamber, a drive shaft of the screw projecting outwardly of the interior chamber and an electric motor for rotating the drive shaft.

Yet another object of this invention is to provide a novel modular irradiator as aforesaid wherein the interior chamber includes an upper chamber portion, means for introducing pressurized air into the upper chamber portion to fluidize the bulk material therein, and means for evacuating the fluidized material from the upper chamber portion.

Another object of this invention is to provide a novel modular irradiator as aforesaid wherein the first and second conveyors are undulating tubes to prevent radiation streaming.

Still another object of this invention is to provide a novel modular irradiator of the type aforesaid wherein the first conveyor is a tube for gravity conveying granular material axially relative to the interior chamber of each irradiator, the tube carrying a spiral screw on the exterior thereof defining the second conveyor, and means for rotating the tube in a direction to rotate the screw to elevate the material upwardly from a lower portion of the interior chamber.

Still another object of this invention is to provide a novel modular irradiator as immediately aforesaid wherein the first conveyor or tube is disposed in axial sliding and rotational relationship relative to another tube forming part of the overall mill conveyor system. One modular unit being connected to another modular unit at their lower end and thus comprising a double modular unit. Material conveyed downward through tubes on one unit to top of screw conveyor which screws downward and pushes material into bottom of joined units for second screw conveyor moves material up. This is especially useful for handling viscous or bulky materials which cannot be pneumatically fluidized. Small tube connections can be made to unit for supply of water or other solvents to aid in fluidizing or purging of unit.

Another object of this invention is to provide a novel irradiator for irradiating both bulk, packaged and/or palletized material including a generally upright cylindrical wall defining an interior chamber, a first conveyor for directing granular bulk material generally downwardly and exteriorly of the cylindrical wall, a second conveyor for conveying the ganular bulk material generally upwardly and interiorly of the cylindrical wall, a third conveyor for conveying and/or supporting palletized/packaged material, the third conveyor being exteriorly of the cylindrical wall, and means between the second conveyor and the third conveyor for subjecting the bulk material or the palletized/packaged material or both the bulk and palletize/packaged material to gamma rays during the movement of the bulk and/or palletized/packaged material by the first, second and/or third conveyors.

Still another object of this invention is to provide a novel bulk and/or palletized/packaged material irradiator as aforesaid wherein the third conveyor is a spiral conveyor or a plurality of reciprocal and rotatable conveyors disposed exteriorly about the periphery of the gamma ray source thus effecting optimum desired dosage of either bulk and/or palletized/packaged material.

Another object of this invention is to provide a novel irradiator as set forth in the last object, including a radiation shielding pool for the gamma ray source, means for elevating the gamma ray source from the pool to a position above the pool and adjacent the third conveyor for irradiating palletized/packaged material thereon, the gamma ray source being in a cylindrical or annular array, and means for axially moving the modular bulk irradiator into and out of the cylindrically disposed gamma ray source.

Another object of this invention is to provide a novel method of irradiating bulk granular material by transporting the bulk granular material in a first direction along a first path of travel, thereafter transporting the bulk granular material in a second direction opposite to the first direction along a second path of travel, and irradiating the bulk granular material by gamma rays from a source disposed lengthwise along and generally parallel to the first paths of travel.

Still another object of this invention is to provide a novel method as aforesaid wherein one of the first and second paths of travel can be rotated eccentrically relative to the gamma ray source to vary the relative positions thereof thus altering as desired the dosage requirements and/or bulk material throughout speed.

Yet another object of this invention is to provide a novel irradiating method wherein the first direction of travel is downward, the second direction is upward and the second path of travel is spiral.

Still another object of this invention is to provide a novel irradiating method as described heretofore including the step of conveying and/or supporting palletized/packaged material along or at, respectively, a third path of travel or position exteriorly of and in generally surrounding relationship to the gamma ray source whereby bulk material alone, palletized/packaged material alone, or both bulk and palletized/packaged materials simultaneously can be irradiated.

With the above, and other objects in view that will hereinafter appear, the nature of the invention will be more clearly understood by reference to the following detailed description, the appended claims and the several views illustrated in the accompanying drawings.

IN THE DRAWINGS:

FIG. 2 is an enlarged cross-sectional view taken generally along line 2—2 of FIG. 1 and illustrates eight identical modular irradiators, both rack type and individual tubular gamma ray source elements and the base for the latter.

FIG. 3 is a side perspective view of a rack housing a series of gamma ray source elements (Cobalt-60) and a plurality of projections which are insertable in openings of the base.

FIG. 4 is a perspective view of an individual gamma ray source (Cesium-137) and illustrates a tube housing the source and having a lower projection for receipt in selected ones of the base openings.

FIG. 5 is a bottom plan view taken along line 5—5 of FIG. 4, and illustrates the projection eccentric to the access of the tube for rotating the tube to change the central axis of the source element and thus enable it to remain in close proximity to an adjacent irradiator even though the irradiator has been rotated to a new orientation on the base plate so as to maintain close proximity at all times of the radioactive source elements with respect to the irradiation chambers and, thus minimize parasitic gamma ray absorption in water gaps and construction materials.

Figure 6:
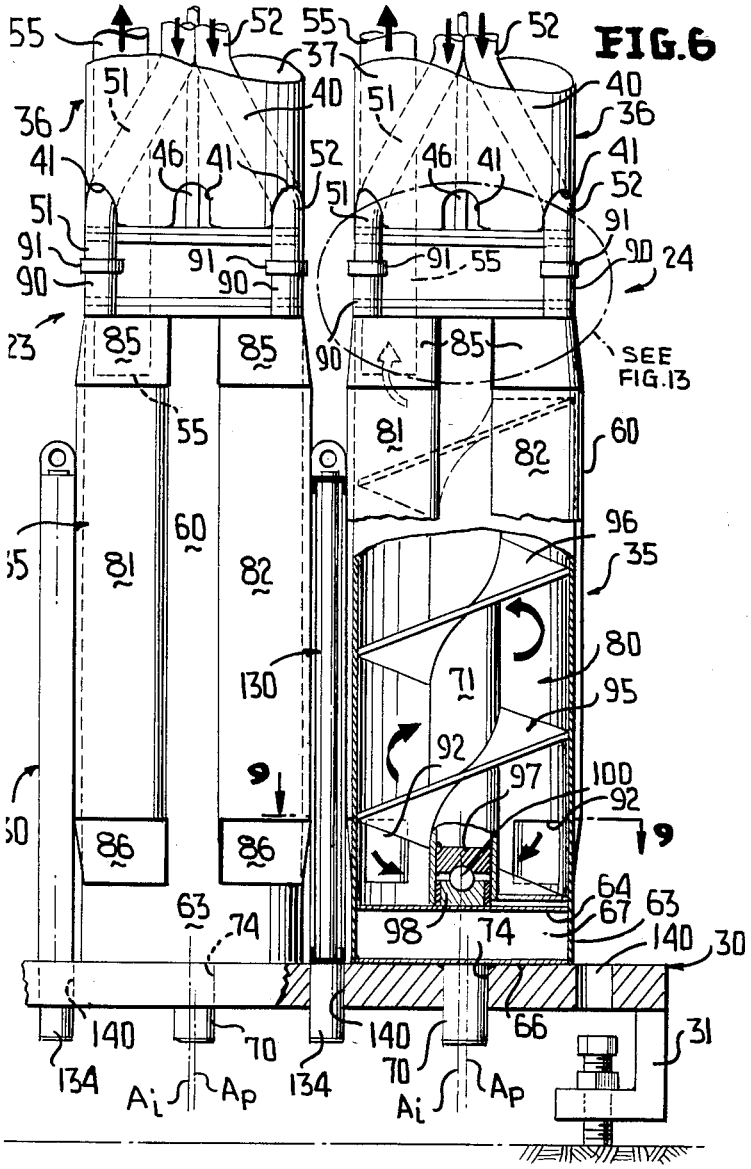

FIG. 6 is an enlarged cross-sectional view taken generally along line 6—6 of FIG. 2 and illustrates tubular conveyors for delivering bulk material downwardly into an interior chamber of each irradiator and a spiral screw for upwardly spirally conveying the bulk material incident to the irradiation thereof.

Figure 7:
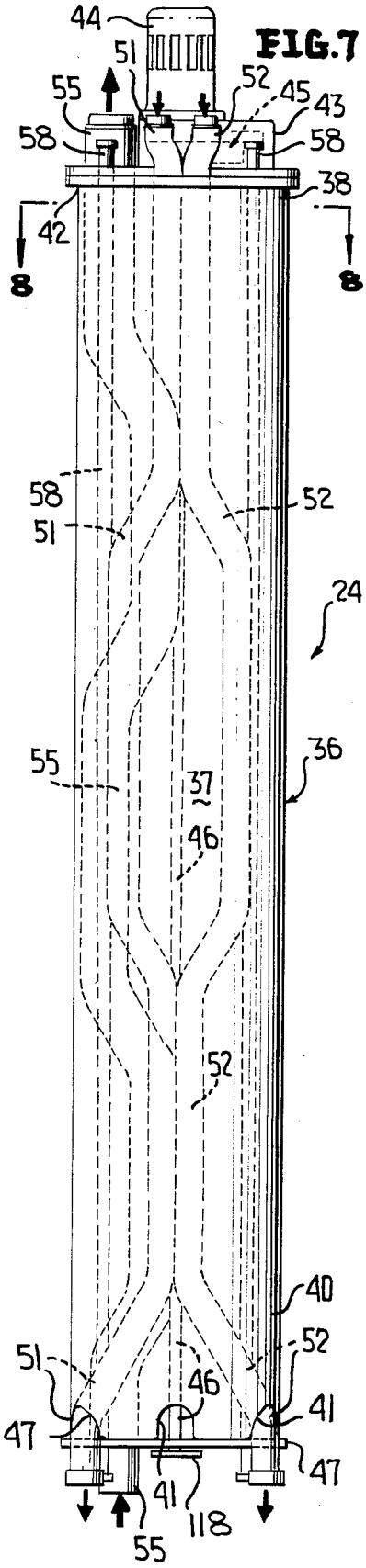

FIG. 7 is a side elevational view of an upper portion of one of the modular irradiators and illustrates the undulating configuration of tubular conveyors to reduce radiation streaming.

Figure 8:
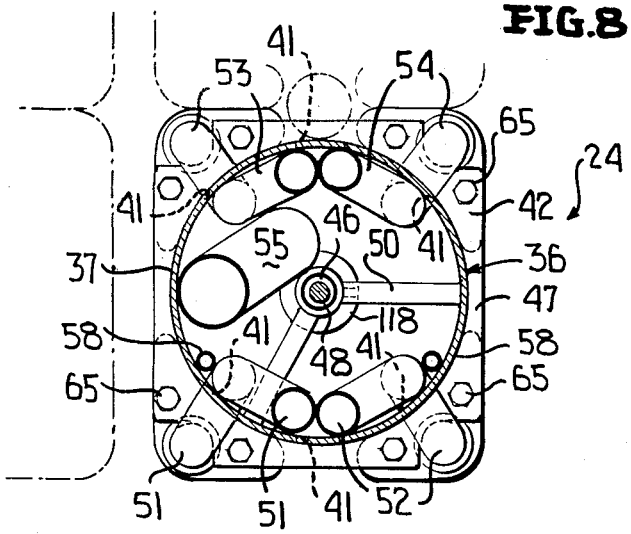

FIG. 8 is a cross-sectional view taken generally along line 8—8 of FIG. 7 and illustrates details of four undulating conveyors for delivering bulk material into the interior chamber and one undulating tubular conveyor for conveying fluidized irradiated bulk material from the interior chamber.

FIG. 9 is an enlarged cross-sectional view taken generally along line 9—9 of FIG. 6 and illustrates details of four conveyors for conveying bulk material into the interior chamber of a modular irradiator.

FIG. 10 is a cross-sectional view taken generally along line 10—10 of FIG. 9 and illustrates the manner in which the bulk material is fed downwardly into the interior container, spirally upwardly therein, fluidized and conveyed outwardly from the interior chamber.

FIG. 11 is a fragmentary sectional view of a modification of the modular irradiator, and illustrates a fluidizing pipe within one of the bulk material feed conveyors which opens into an upper portion of an interior chamber for fluidizing the bulk material therein.

FIG. 12 is a fragmentary sectional view of another embodiment of the irradiator and illustrates a fluidizing/cleaning pipe within and along generally the entire length of one of the first conveyors with a plurality of inlets for directing air into the interior chamber for fluidizing/cleaning purposes.

FIG. 13 is a fragmentary enlarged partially cross-sectional view of the encircled portion of FIG. 6 and illustrates a flexible drive connection between the screw conveyor and a shaft driven by a motor.

Figure 14:
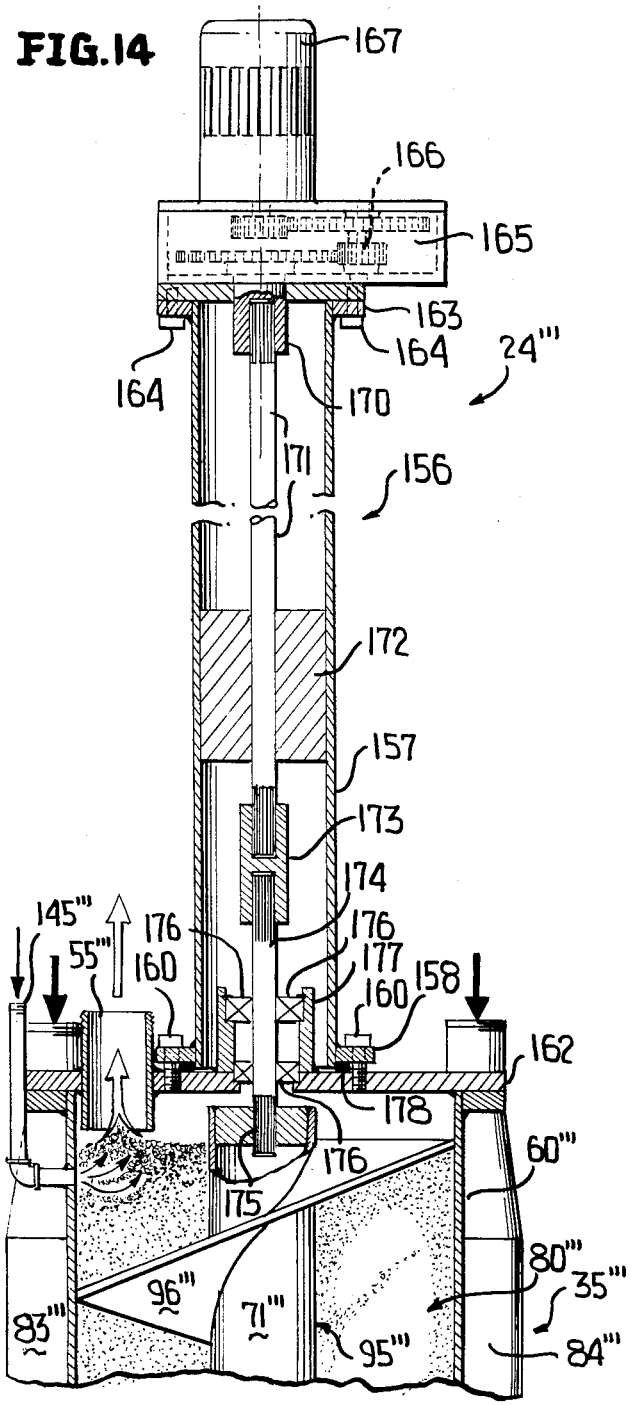

FIG. 14 is a fragmentary axial cross-sectional view of another modular irradiator constructed in accordance with this invention and illustrates a rigid drive connection between an associated motor and a spiral screw conveyor, and lead shielding to absorb streaming gamma rays.

Figure 15:
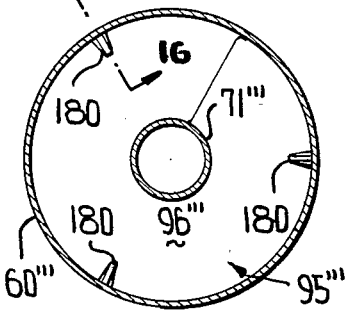

FIG. 15 is a radial cross-sectional view through any one of the modular irradiators heretofore described, and illustrates a plurality of projections positioned along the screw or vane of the spiral conveyor for agitating or tumbling the bulk material as it is transported spirally upwardly.

Figure 16:
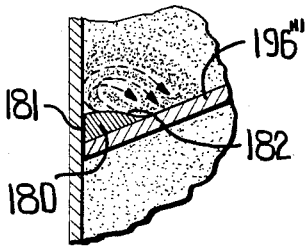

FIG. 16 is an enlarged fragmentary view taken generally along 16—16 of FIG. 15, and graphically illustrates the stirring or tumbling action of the bulk material.

Figure 17:
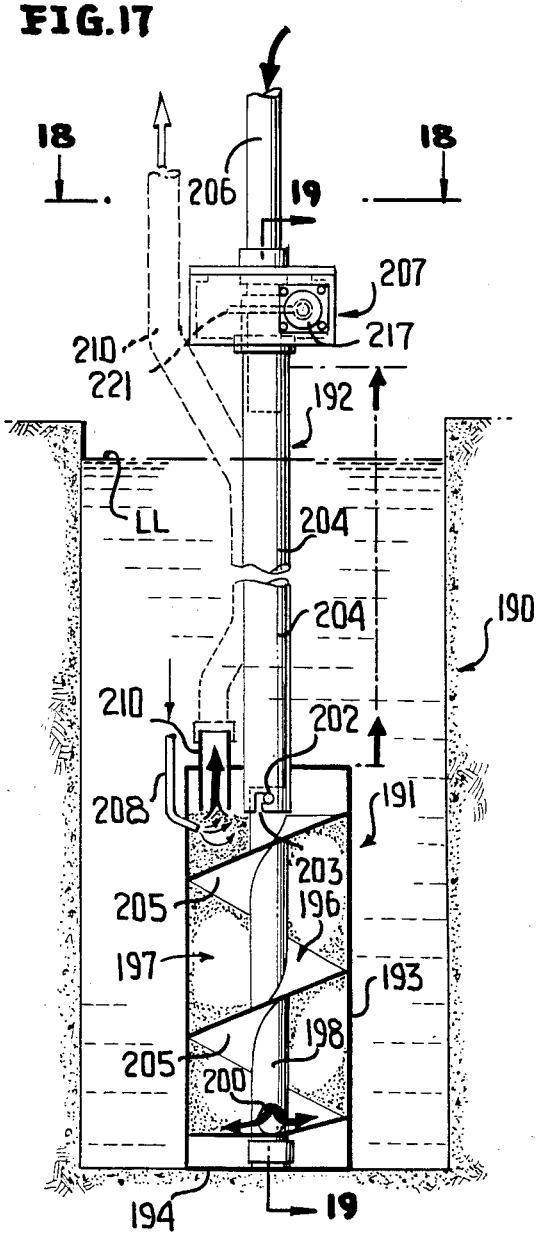

FIG. 17 is a schematic elevational view, partially in cross-section of another modular irradiator of this invention and illustrates an axial tube downwardly through which bulk material is conveyed into an interior chamber, the tube being rotated and carrying a spiral screw for elevating the bulk material upwardly.

Figure 18:
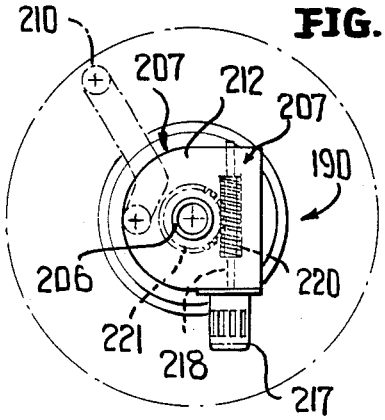

FIG. 18 is a cross-sectional view taken generally along line 18—18 of FIG. 17 and illustrates a worm and wheel drive for rotating the tube and the spiral screw carried thereby.

Figure 19:
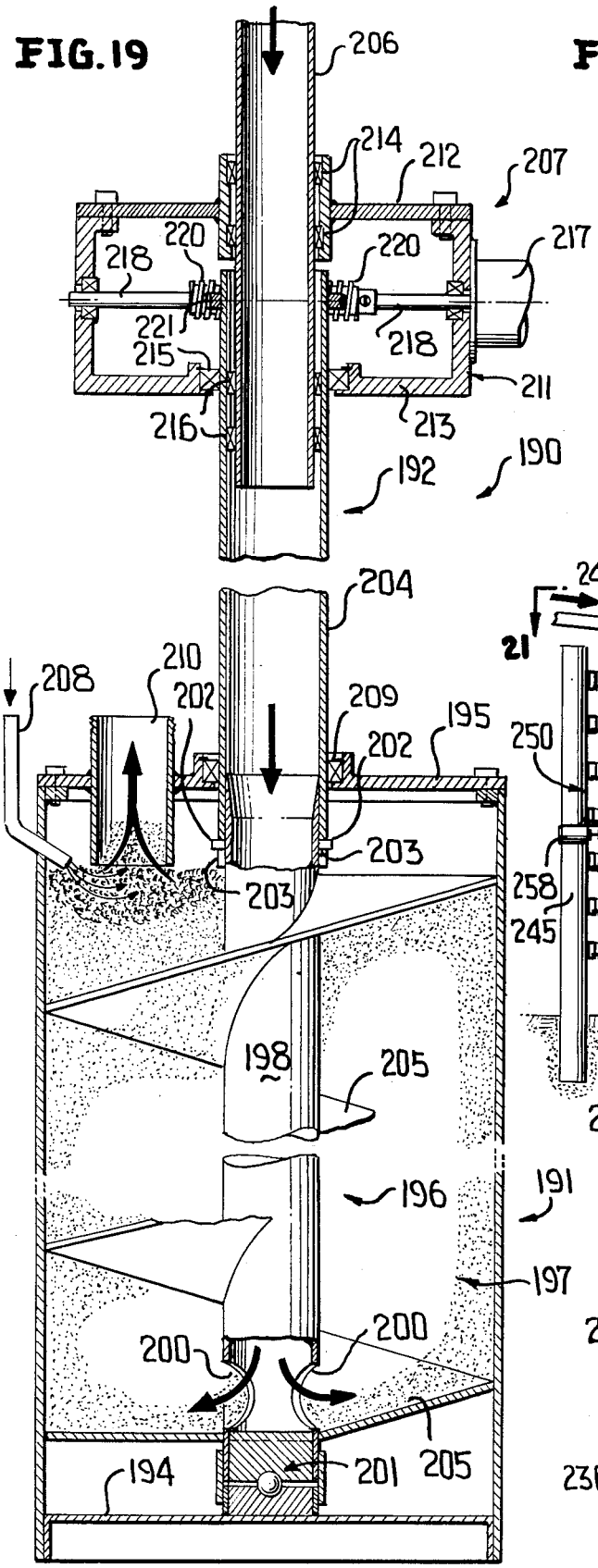

FIG. 19 is an enlarged fragmentary fore-shortened axial cross-sectional view taken generally along 19—19 of FIG. 17 and illustrates details of the irradiator including a pair of relatively telescoping tubes to permit upward and downward movement of the irradiator relative to an associated surrounding cylindrical array of radiation sources.

Figure 20:
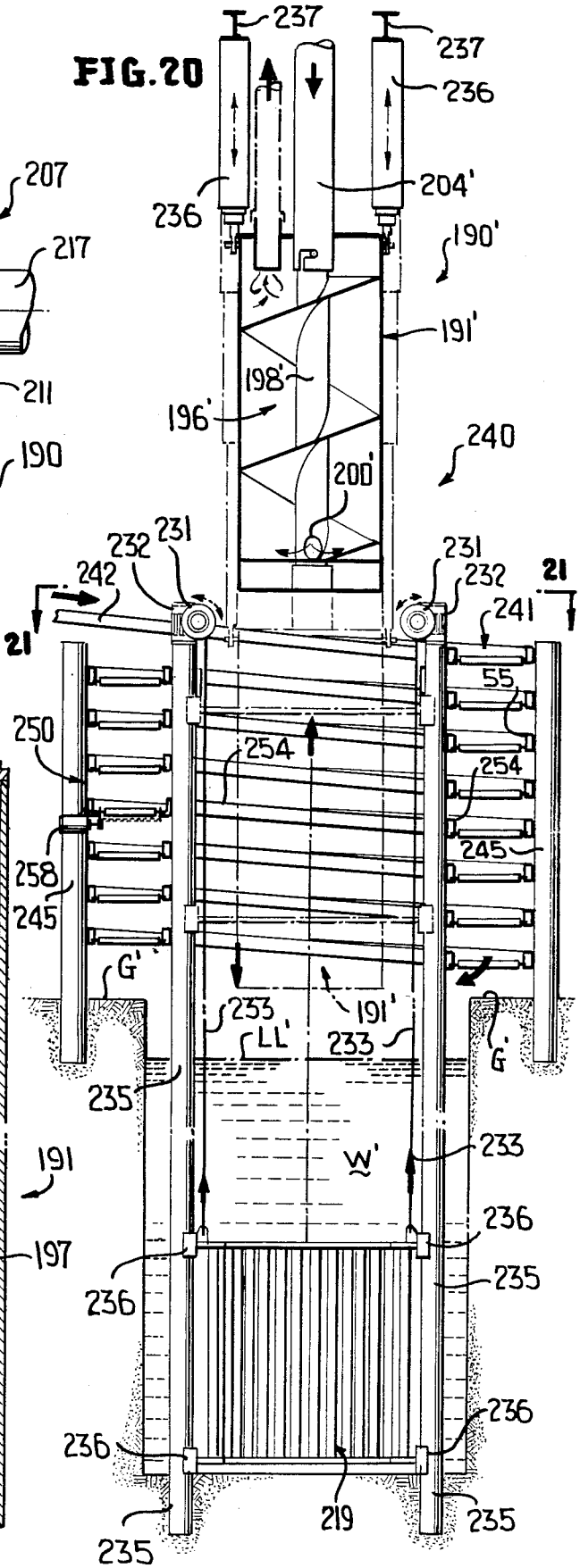

FIG. 20 is a schematic side-elevational view, partially in cross-section of a dual purpose type of irradiator system of the invention and illustrates a modular bulk material irradiator of the type illustrated in FIG. 19 associated with a cylindrical array of source elements which can be elevated from a radiation shielding pool into a irradiation zone outboard of which is a conveyor for packaged or loose material, and the bulk irradiator being mounted for movement into and out of the irradiation zone.

FIG. 21 is a top plan view looking downwardly along the line 21—21 of FIG. 20 and illustrates the manner in which only bulk material, or only packaged or loose material, or both bulk material and packaged or loose material can be irradiated by this irradiator means.

FIG. 22 is an enlarged side elevational view, partially in cross-section, of the irradiator of FIG. 20 with the components thereof positioned during an irradiation process, and illustrates the manner in which both bulk material and packaged or loose material is irradiated.

FIG. 23 is an enlarged fragmentary view taken generally along line 23—23 of FIG. 22 and illustrates a section of the spiral conveyor which can be rotated preferably through 180° increments to expose a different face of the packaged or loose material adjacent the cylindrical gamma ray source.

FIG. 24 is a top plan view of another packaged or loose material conveyor system similar to that of FIG. 21 and illustrates radially inboard and outboard conveyor paths by which packaged or loose material descends from top to bottom through an irradiation zone in a spiral fashion and then returns from bottom to top along a like spiral path.

FIG. 25 is a fragmentary side elevational view of the packaged or loose material conveyor of FIG. 24 and illustrates the manner in which the inboard and outboard conveyor paths are axially offset to maximum irradiation of the packaged or loose material.

FIG. 26 is a fragmentary sectional view taken generally along line 26—26 of FIG. 24 and graphically illustrates the manner in which gamma rays which might not be absorbed by material upon the inboard conveyor path will be absorbed by material on the outboard conveyor path due to the axial staggered relationship of these paths.

Figure 27:
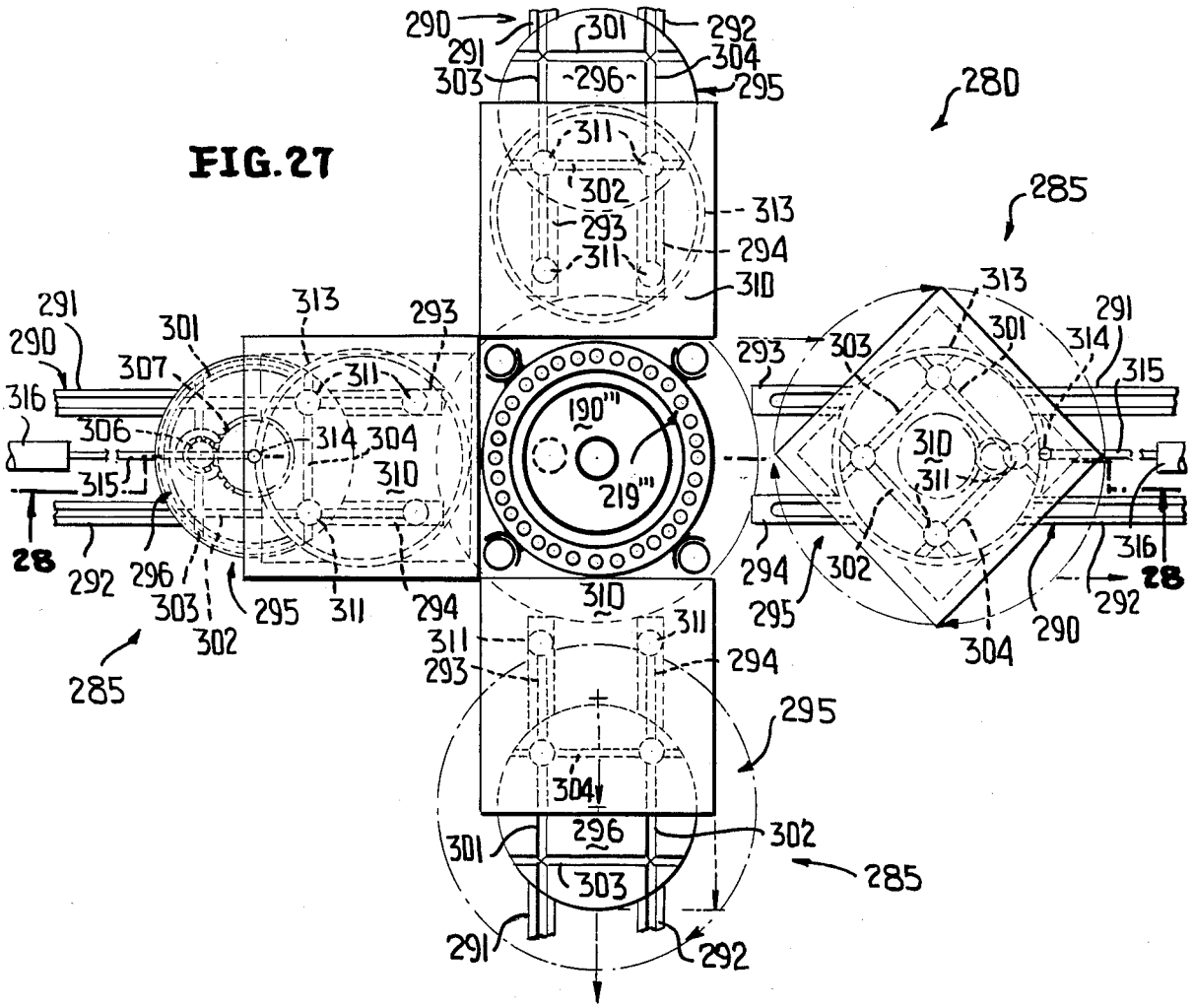

FIG. 27 is a schematic top plan view of another irradiator system for irradiating palletized and/or bulk material and illustrates a central bulk material modular irradiator, a cylindrical gamma ray source and four conveyor means for reciprocally conveying and rotating palletized material to present different faces thereof to the gamma ray source.

Figure 28:
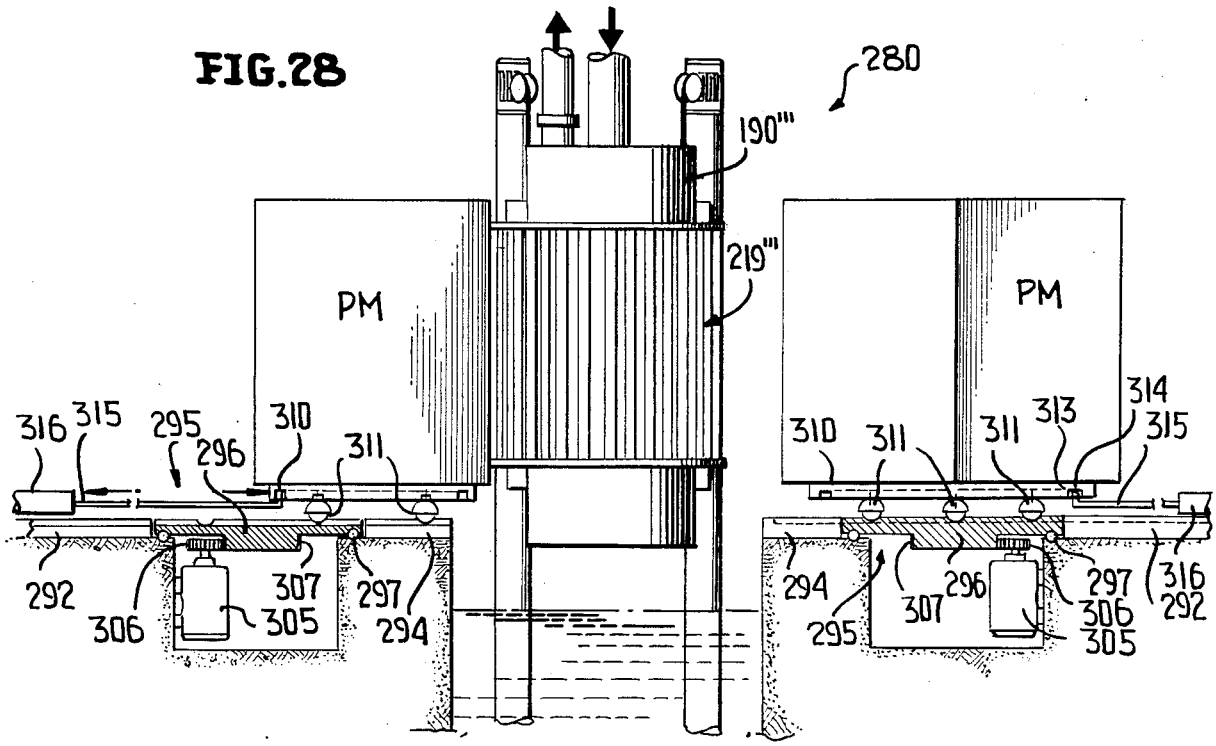

FIG. 28 is a fragmentary side elevational view of the irradiator system of FIG. 27, and illustrates details for effecting reciprocation and rotation of the palletized material conveyors.

Figure 29:
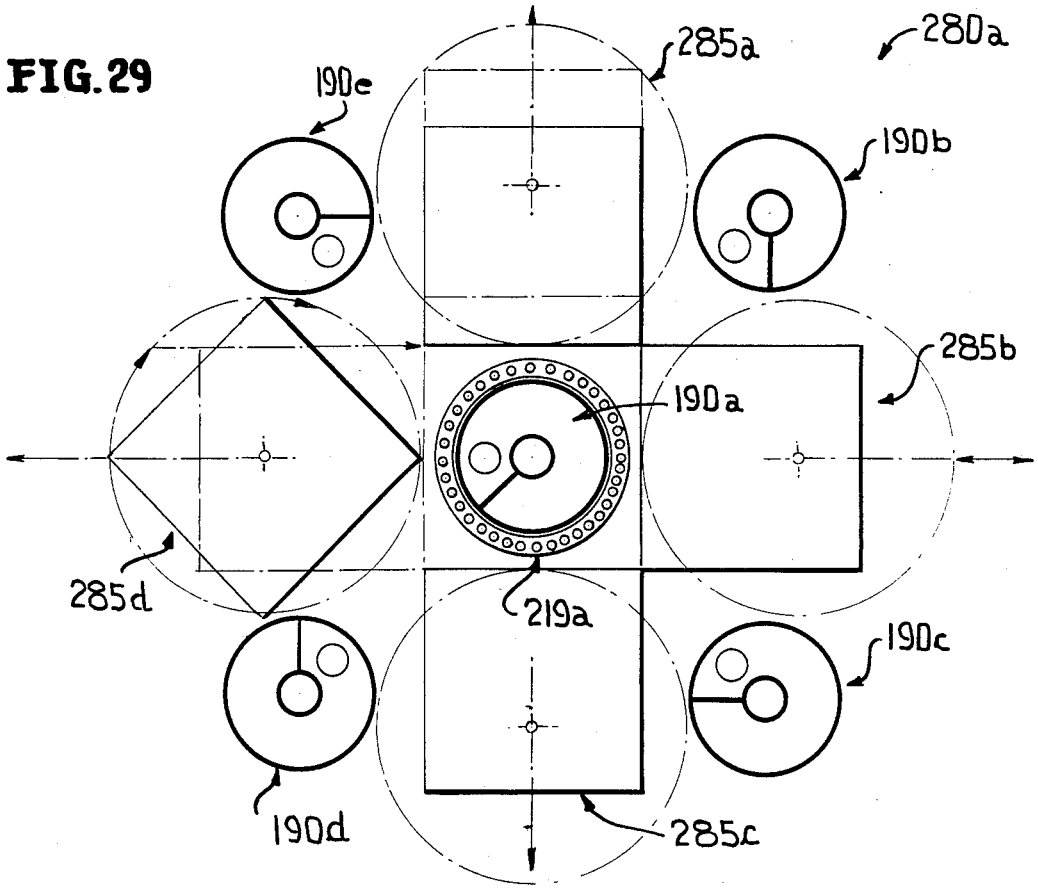

FIG. 29 is a schematic top plan view similar to FIG. 27 and illustrates four additional bulk material modular irradiators positioned one each between pairs of the palletized material conveyors.

Figure 30:
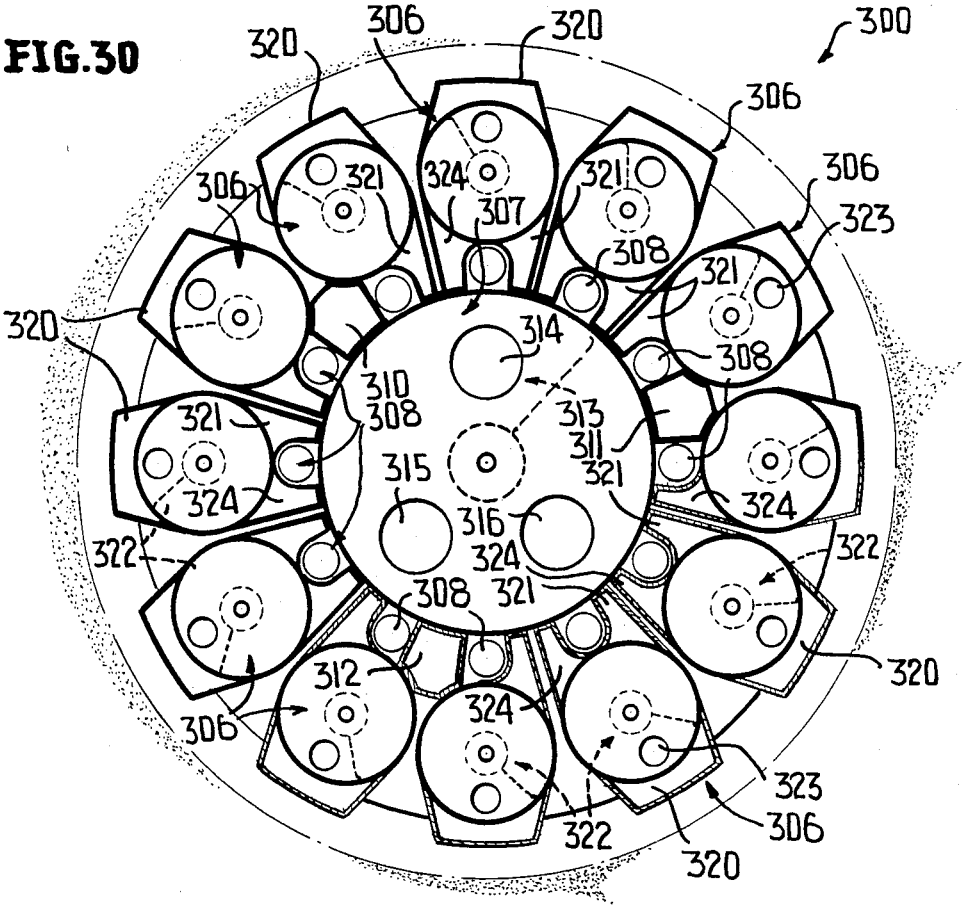

FIG. 30 is a schematic top plan view of another irradiator system for bulk material, and illustrates a central large modular bulk material irradiator surrounded by twelve smaller modular bulk irradiators, and radiation source elements between the larger and the remainder of the irradiators.

Figure 31:
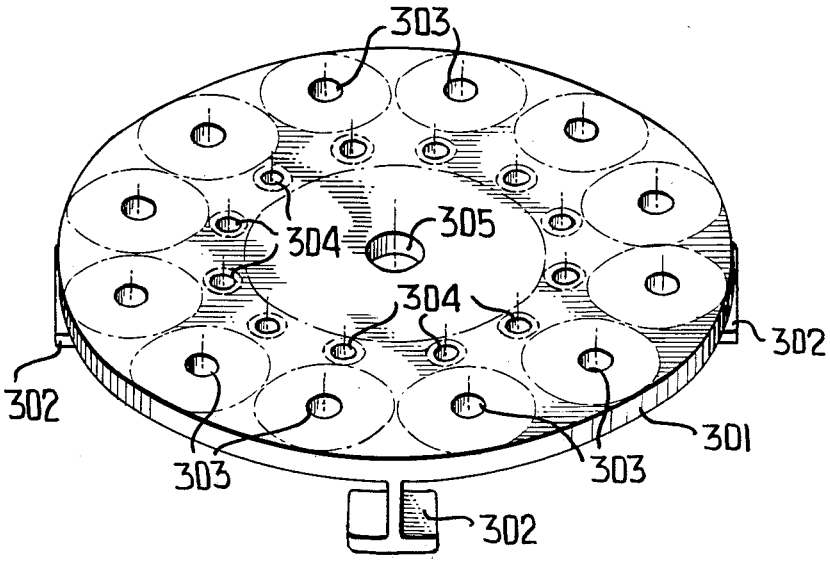

FIG. 31 is a perspective view of a base of the irradiator system of FIG. 30 and illustrates a plurality of openings therein for receiving projections of the modular irradiators and source elements.

Figure 32:
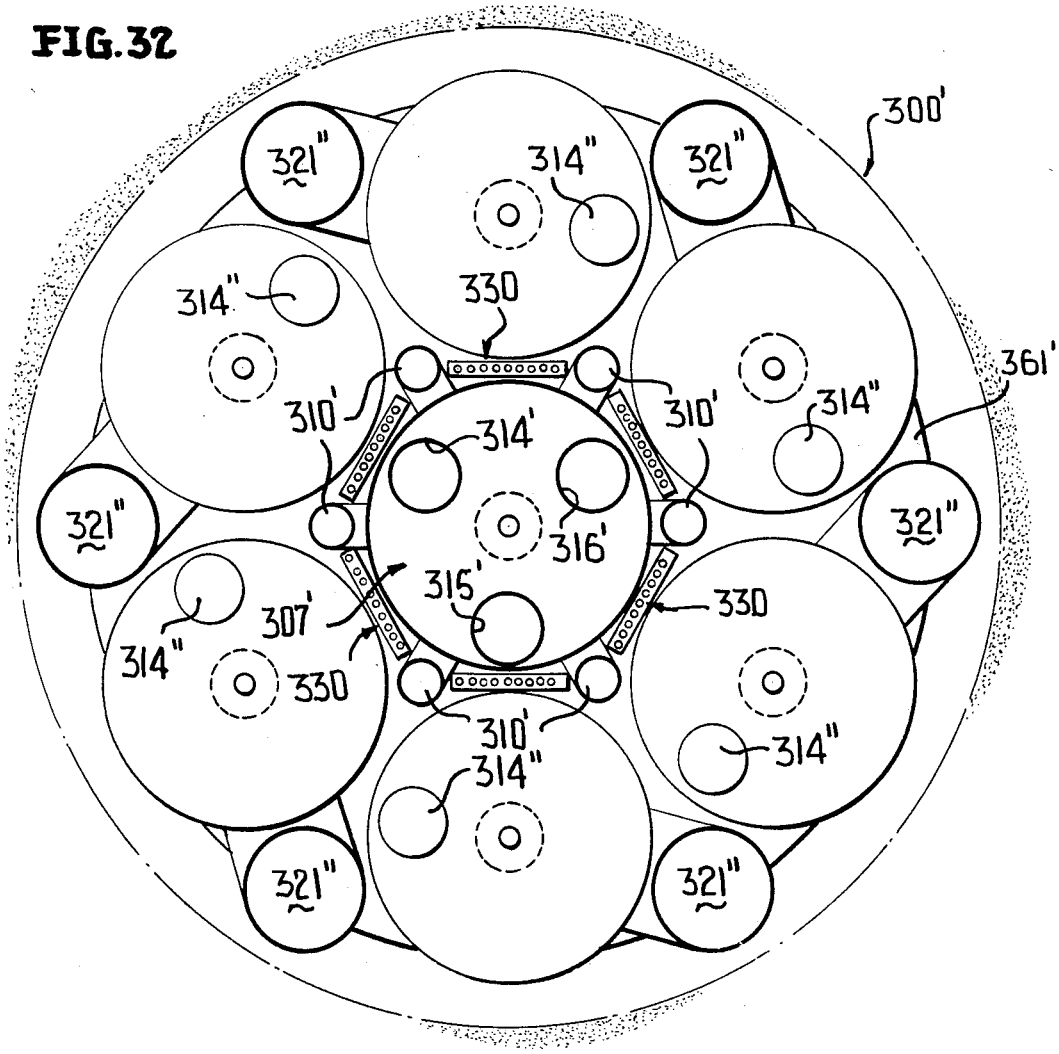

FIG. 32 is a schematic top plan view of another irradiator system, and illustrates a central bulk irradiator, six bulk modular irradiators surrounding the same, and a plurality of racks of source elements between the central and the remaining modular irradiators.

The present invention will be described hereinafter but reference is first made to an overall conventional milling plant P (FIG. 1) to which wheat, for example, or other bulk granular material is delivered by a truck T. The bulk material is dumped in a conventional mechanical conveyor C and is delivered thereby to any one of a number of vertical tanks T1, T2, T3, etc. The wheat is then delivered from any one or all of the tanks T1-T3 over pneumatic conveyors L1-L3, respectively, to conventional apparatus (not shown) which is first utilized to clean the bulk material, and hhis usually takes place through either a number of different sized vibrating screens and/or a mild chlorinated water wash after which the bulk material is cracked (milled) through steel rollers, sifted and subsequently transferred by a pneumatic line or conveyor $L_s$ to vertical storage tanks Ts1, Ts2, Ts3, etc. As an alternative, the pneumatic conveyors L1, L2, and L3 can directly convey the milled bulk material through a pneumatic conveyor Ls1 to an on-site railroad car R for subsequent transfer. Obviously, the vertical storage tanks Ts1, Ts2 and Ts3 can transfer the bulk material through their associated chutes or spouts S to the rail-road car R or the like.

Prior to September 1983 it was customary in the milling and/or grain storage business to treat grain or flour with ethylene dibromide (EDB) which, though an effective pesticide, was also determined to be carcinogenic and has been banned by the FDA. Though other chemical pesticides or fungicides are used as replacements for EDB, irradiation of grain, flour or the like is not only an effective pesticide/fungicide, but also creates a marked increase in shelf-life in complete absence of carcinogenic activity.

Thus, in keeping with the present invention, a novel irradiation system, generally designated by the reference numeral 10, is provided preferably in conjunction with the bulk material treating plant P, for irradiating the bulk material in a continuous fashion during the processing thereof. While the irradiation of the bulk material can take place at virtually any stage of the processing thereof, several options are available, as for example, processing directly from the conveyor C, processing after storage in the tanks T1, T2, T3, but before milling, after milling, but before storage in the storage tanks Ts1, Ts2, Ts3, or prior to direct transfer to the railroad car R without final storage. For purposes of this invention, the pneumatic conveyors L1, L2 and L3 are shown connected between the tanks T1, T2 and T3, respectively, and the irradiation system 10 through a valved pneumatic conveyor system 20, prior to the wheat or bulk material being cleansed, screened, washed, cracked, etc. However, it is to be understood that the invention is equally applicable to the irradiation of the bulk material at any time during the processing thereof.

Alternatively, the irradiator #10 could be used at a plant where flour is processed into premixes or used for other purposes. In this case, flour could be transported from a transfer truck or railroad car through the irradiator into the storage tanks.

The valved pneumatic conveyor system 20 includes a main pneumatic conveyor or manifold Cm to which is connected the pneumatic conveyors L1, L2 and L3. The main pneumatic conveyor or manifold Cm includes a plurality of gate valves V1–V5 which are pneumatically operated through appropriate electrical control from a main control panel (not shown) in a conventional manner. The valve V1, V4 and V5 are disposed to control the flow of the bulk material from the tanks T1–T3 through the pneumatic conveyors L1–L3, respectively, to the main pneumatic conveyor Cm. A plurality of pneumatic conveyors C1–C4 are connected to the main pneumatic manifold Cm, and the pneumatic conveyors C1–C4 function to feed the bulk material into identical respective modular irradiators 21–24 of the irradiator system 10. Likewise, pneumatic conveyors C5–C8 function to deliver the irradiated bulk material from the respective modular irradiators 21–24 to the pneumatic conveyor Ls for subsequent disposal to the storage tanks Ts1–Ts3 or the railroad car R. A plurality of adjustable gate valves V6–V19 which are likewise conventionally pneumatically operated through electronic controls (not shown) are selectively positioned at intersections of the various pneumatic conveyors, C1–C8 and Ls to regulate the overall flow of the bulk material from the tanks T1–T3, singularly or collectively, and any one, all or a combination of the individual modular irradiators 21–24. Typical examples of the manner in which the pneumatic conveyor system 20 can operate by selectively positioning the valves V1–V19 will be described hereinafter. Suffice it to say that the valved pneumatic conveyor system 20 is effective to selectively direct the bulk material into and out of any one or a combination of the irradiators 21–24 through the pneumatic conveyors C1–C4 and C5–C8, respectively.

The irradiator system 10 is a pool-type which simply requires the digging or boring of a hole or pool 11 defined by a peripheral wall 12 and a bottom wall 13. The hole or pool 11 is below ground level G and is located proximate the plant P. A concrete or stainless tank with appropriate ballast is placed in the hole 11 and appropriately anchored against the potential for lifting due to surrounding subsurface water tables. The tank, hole or pool 11 is then filled with demineralized water W to an upper liquid level LL. The water W is normally circulated and appropriately cleaned and this in turn provides the necessary protected environment for the radioiostopic sources (Cesium-137 or Cobalt-60) which in turn establish a radiation zone Z.

The individual modular irradiators 21–24 are supported upon means 30 (FIGS. 1 and 2) for defining a support or base which is generally of a squared or polygonal configuration and includes a plurality of identical feet 31 for elevating the base 30 above the bottom wall 13 of the hole or pool 11. Four additional modular irradiators 25–28 are shown supported upon the base in FIG. 2 adjacent the irradiators 21–24. Additional modular irradiators (not shown) can be supported upon the base 30, as will be described more fully hereinafter, or those irradiators 21–28 shown can be removed from the base 30 and repositioned thereon in other locations, as will also be described more fully hereinafter.

Inasmuch as the modular irradiators 21–28 are identical the following description of the modular irradiator 24, which is fully illustrated in FIGS. 6–13, is fully applicable to the remaining irradiators 22–28.

Figure 1:
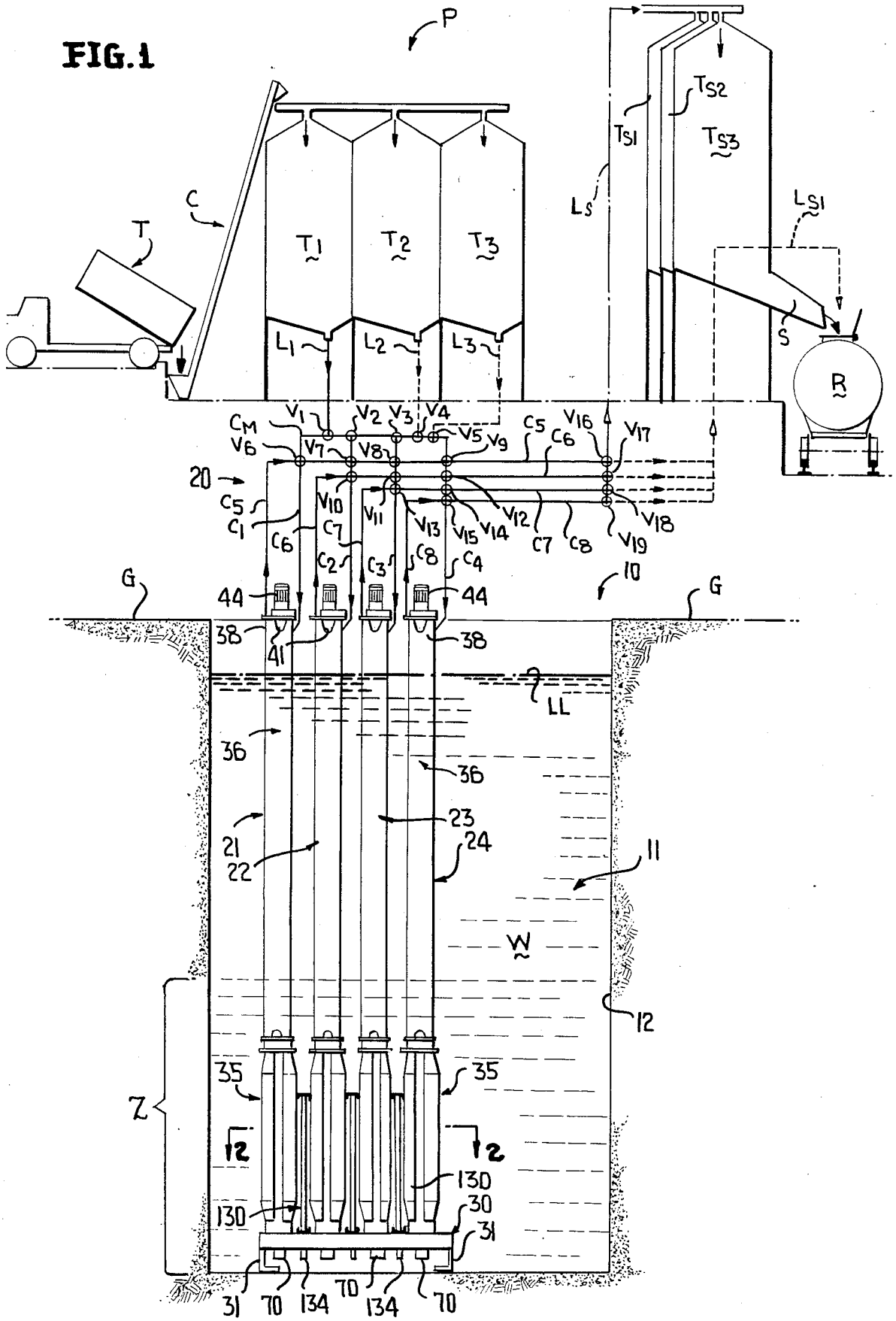
FIG. 1 is a schematic elevational view of a pool-type irradiation system, and illustrates a plurality of modular irradiators supported upon a base together with gamma ray source elements and a conveying system for conveying bulk material selectively to and from the modular irradiators.

The modular irradiator 24 is essentially a self-contained unit formed by a lower end portion 35 (FIGS. 6 and 10) which seats upon and is supported by the base 30 and an upper end portion 36 (FIGS. 6 and 7) which is supported upon and is connected to the lower end portion 35 (FIG. 1).

The upper end portion 36 of the modular irradiator 24 includes an exterior cylindrical shell or housing 37 (FIG. 7) having an upper end 38 and a lower end 40, the latter of which includes a plurality of openings 41 spaced about the periphery thereof (FIGS. 6 and 7). A flange 42 (FIG. 7) is welded to the upper end 38 of the housing 37 and an end cap 43 having a plurality of openings (not shown) therein, is bolted to the flange 42. The end cap 43 supports a variable speed, reversible D.C. electric motor 44 (or a variable speed A.C. motor) whose output is connected through appropriate conventional reduction gearing 45 within the end cap 43 to drive means in the form of a drive shaft 46 (FIGS. 7, 8 and 13) extending the length of the housing 37 and projecting beyond a lower flange 47 (FIG. 13) welded to the end 40 of the housing 37. The shaft 46 is coaxial to the axis of the housing 37 (FIG. 8) and is suitably supported for rotation by conventional bearings 48 (FIG. 13) carried by several spiders 50 (FIGS. 8 and 13) welded to the inner surface of the housing 37. Though only a single spider 50 and its bearing 48 is shown (FIGS. 8 and 13), it is to be understood that several of such spiders 50 and bearings 48 are positioned within the housing 37 preferably at least at the upper and lower ends 38, 40, respectively, and midway therebetween. The motor 44 is connected to a suitable D.C. source (not shown) to rotate the shaft 46 in a desired direction and at a desired rate to elevate bulk granular material through the lower end portion 35 of the irradiator 24, as will be described more fully hereinafter.

Conveying means for introducing bulk material into the modular irradiator 24 in a generally downward direction along a predetermined path of travel under the influence of gravity are generally designated by the reference numerals 51–54 (FIGS. 6–8), and are simply tubes, pipes or conduits each of an undulating configuration along the length thereof to prevent irradiation streaming. The upper ends (unnumbered) of the tubes 51–54 project through the openings (unillustrated and unnumbered) of the end cap 43 and are connected to the pneumatic conveyor C4 (FIG. 1) of the valved pneumatic conveyor system 20. Thus, any bulk material flowing through the pneumatic conveyor C4 will be introduced into the tubes 51–54 and will move downwardly therethrough. While the tubes 51–54 are generally housed entirely within the housing 37, lower ends (unnumbered) of the tubes 51–54 project outwardly of the housing end 40 through four of the openings 41 thereof, as is most apparent from FIGS. 6 and 7 of the drawings.

Further conveying means in the form of another conduit or tube 55 is housed generally within the housing 37 except for an upper end (unnumbered) which projects outwardly through one of the openings (unillustrated and unnumbered) of the end cap 43. The latter end is connected by suitable conventional coupling means to the pneumatic conveyor C8 (FIG. 1) to transfer irradiated bulk material outwardly of the modular irradiator 24, as will be described more specifically hereinafter. The lower end (unnumbered) of the tube 55 projects below the flange 47 and below the ends of the tubes 51–54 (FIG. 7).

Another tube or conduit 58 (FIGS. 7 and 10) is housed generally entirely of the housing 37 except for an upper end thereof which projects outwardly through one of the unillustrated and unnumbered openings of the end cap 43. The latter end of the conduit or tube 58 is connected to a source of pressurized air for fluidizing the irradiated granular material incident to the pneumatic evacuation thereof from the lower end portion 35 of the modular irradiator 24 through the tube 55, as will be described more fully hereinafter.

The lower end portion 35 (FIGS. 6, 9 and 10) of the modular irradiator 24 includes a generally cylindrical wall 60 having an upper end 61 (FIG. 13) to which is exteriorly welded a flange 62 and a lower end 63 (FIG. 6) interiorly of which is welded a circular bottom plate 64. The flange 47 of the housing 37 of the upper end portion 36 rests upon the flange 62 (FIG. 6 and 13) of the lower end portion 35, and the flanges 47, 62 are bolted together by a series of bolts and nuts collectively designated by the reference numerals 65 (FIG. 13). A circular bottom plate or wall 66 (FIG. 6) is welded in spaced relationship to the plate 64 and between the plates 64, 66 there is located ballast 67, such as lead, which facilitates the lowering of the modular irradiator 24 into the water W against the inherent buoyancy offered thereby, particularly since the lower end portion 35 of the modular irradiator 24 is completely airtight.

Means 70 (FIGS. 1, 6 and 10) in the form of a probe or projection is welded to the bottom wall or plate 66 of the irradiator lower end portion 35 and the axis Ap (FIG. 6) thereof is radially offset from and thus eccentric to an axis Ai of the modular irradiator 24 and specifically the axis of the shaft 46 and a tubular shaft 7! (FIG. 6) driven thereby. The projection of probe 70 is received in means 74 (FIGS. 2 and 6) defined by a plurality of circular openings in the base 30 thereby cooperating with the projections 70 of all of the irradiators 24–28 (FIG. 2) to locate the same relative to the base and to each other. The projections 70 of the irradiators 24–28 are so related to the respective openings 74 so as to selectively vary the position of the irradiators relative to each other and thereby obtain optimum dosage. It is, of course, necessary to obtain maximum utilization of all radiation being emitted from radioactive source elements, such as gamma ray source means 130,135 which will be described more fully hereinafter. However, at this point it is sufficient simply to note that the gamma ray source means 130 is a planar array of Cobalt-60 elements whereas the gamma ray source means 135 is a tubular source element of Cesium-137. In order to obtain maximum utilization of radiation the irradiator design must be such as to minimize the amount of cladding materials, structural materials and any intervening materials which might exist between the gamma ray sources 130,135 and the product which is to be irradiated. In view of the fact that most of the irradiators disclosed herein are under water irradiators, any space which exists between the source elements 130,135 and the material being irradiated is filled with water. As a consequence of the latter, water would tend to parasitically absorb gamma rays and thereby reduce the amount of radiation made available to the product. It is necessary at all times to keep this space at an absolute minimum as a required variation in dose, such as a lowering of the dose, can be obtained by changing the feed rate of the product through the irradiator. With such a change, one still obtains maximum utilization of the radioactive source and does not waste the gamma rays in parasitic absorption on other materials. Accordingly the projection 70 of the irradiators 24–28 is for the purpose of permitting each modular unit or irradiator 24–28 to be individually lifted, rotated through 90° or 180°, lowered and repositioned in such a manner as to enable the space to be open between adjacent pairs of irradiators as for example, the pairs 21, 25; 22,26; 23,27 and 24,28. This change in space thus accommodates different types of gamma ray source elements, namely, the gamma ray sources or elements 130,135.

In the case of the gamma ray source 130 (Cobalt-60) a rack or rack member 132 is utilized which contains half-inch Cobalt-60 elements and thus the overall width of the rack 132 might be on the order of three-quarter of one inch. However, in the case of the gamma ray sources 135 (Cesium-137), these singular elements have an outside diameter of approximately $2\frac{5}{8}$ inches thus necessitating a greater distance between adjacent irradiators 24–28 than in the case of Cobalt-60. Thus, as is best illustrated in FIG. 2, pairs of irradiators 21,25, for example, are virtually touching yet there is a gap therebetween to receive the radiation source 135 while at the same time the space between others of the pairs 21,22; 25,26; etc., can be changed or increased to accommodate a rack 132. Thus, by first lifting from the base plate 30 anyone of the irradiators 24–28 and then rotating one at a time, two adjacent irradiators through 180°, the eccentricity of the projections 70 would allow the space therebetween to open or close. The eccentricity of the projections 70 is such that not only the 180° rotation allows for separation between two adjacent irradiators, but it also opens up the spac between two other additional irradiators in close proximity and, thus, permits two racks of Cobalt-60 elements to be inserted. Thus, in the arrangement shown in FIG. 2 the pairs of irradiators 21,25; 22,26; 23,27; and 24,28 are relatively close to each other whereas others of the pairs 21,22; 22,23; 23,24; 25,26; 26,27; and 27,28 are spaced further apart. However, by the lifting, rotating and lowering heretofore described variations in distances between the irradiators 21–28 can be achieved. Thus, the probes or projections 70 of the irradiators 21–28 and the opening 74 of the base 30 function not only to locate the irradiators 21–28 upon the base 30, but also to alter or vary the space between the irradiators 21,28 to accommodate the different gamma ray sources 130,135 and thus alter the irradiation dosage.

The bulk material is fed into an interior chamber 80 (FIGS. 6 and 10) defined by the wall 60 through four exterior tubes or conduits 81–84 (FIGS. 6, 9 and 10) each having a tapered upper end portion 85, a lower tapered end portion 86, and inwardly turned legs 87, 88 (FIG. 9) welded to the exterior of the cylindrical wall 60. The tubes 81–84 are generally of an irregular shaped, cross-sectional configuration (FIG. 9), and the tapered upper portions 85 thereof are connected by short lengths of tubing 90 and conventional quick-couplings 91 to the respective tubes 51–54 of the upper end portion 36. The lower tapered portions 86 of the tubes 81–84 open into the interior chamber through generally rectangular openings 92 formed in the cylinder or cylindrical wall 60.

The bulk material is deposited through the openings 92 into the interior chamber 80 adjacent the bottom wall 64 and is then conveyed upwardly in a spiral fashion by a helical or spiral screw conveyor 95 defined in part by the tubular shaft 71 and a screw or helix 96 welded thereto. The screw conveyor 95 is mounted for rotation upon the plate 64 by means of a thrust bearing defined by opposing thrust washers 97, 98 (FIG. 6) welded interiorly of the tube 71 and upon the plate 64, respectively, with a ball 100 therebetween. The axis Ai is, of course, coaxial with the center of the ball 100 and the axis of the tube 71.

Flexible drive connection means 105 (FIG. 13) for the screw conveyor 95 is housed within the cylindrical wall 60 and includes a conventional rubber vibration mount unit 106 formed by a tubular sleeve 107, a rubber body 108 and an annular flange 110. The flange 110 is secured by bolts 111 to a plate 112 housed within and welded to the cylindrical wall 60 and from which depends a housing 113 supporting a conventional bearing 114 within the inner race of which is housed an upper end (unnumbered) of the shaft 71. A plate 115 having a radially outwardly opening generally U-shaped slot 116 is welded to the upper edge of the tube 71 and receives an end (unnumbered) of a pin 119 which is friction fit in the sleeve 107 and has an opposite end (unnumbered) received in another radially outwardly opening generally U-shaped slot 117 of a plate 118 welded to the shaft 46. As the shaft 46 is rotated by the motor 44 (FIG. 7) the nutational drive of the flexible drive connector means 105, particularly through the pin 119 and the rubber body 108, is translated into the rotation of the shaft 71 which through the screw or helix 96 conveys the granular material upwardly through the interior chamber so for subsequent discharge therefrom through the conduit 55 whose lower end (FIG. 13) is exposed to the interior chamber 80. The conduit 55, as noted earlier, is connected to the conduit C5 which is part of the pneumatic conveyor system 20 and the latter includes a suitable source of suction (not shown). The bulk material is preferably fluidized in the upper end portion of the interior chamber 80 by pressurized air directed thereinto (FIG. 10) through a tube 120 which is suitably connected to the tube 58 (FIG. 7) and has a discharge end adjacent the open end (unnumbered) of the tube 55 (FIG. 10).

During the passage of the bulk material downwardly through the tubes 81 through 84 and upwardly in the interior chamber 80 by means of the screw conveyor 95, the same is subject to irradiation by gamma ray source means in the form of radioactive source materials, such as the Cobalt-60 and Cesium-137 sources 130, 135 (FIGS. 3 and 4, respectively) earlier briefly described. The gamma ray source means 130 is a planar array of Cobalt-60 source elements 131 which are housed in tubes forming part of a rack or rack member 132 having a bottom rail 133 from which project downwardly a plurality of cylindrical projections or probes 134. The projections or probes 134 are spaced from each other predetermined distances which correspond to the distances between a plurality of similar sized openings 140 formed in the base 30 (FIG. 2) or even multiples or even divisions thereof. The racks 132 are positioned as desired with the projections 134 thereof in selected ones of the openings 140 depending upon which of the irradiators 21–28 is to be utilized, the spacing therebetween, the degree of dosage effected thereby, etc., as was described fully heretofore.

In lieu of the gamma ray sources 130 or in conjunction therewith, Cesium-137 source elements are housed within a conventional source tube 136 (FIG. 4) having a longitudinal axis At (FIG. 5) and a projection or probe 137 having an axis Apl which is radially offset from the axis At. The siz of the probe or projection 137 corresponds to the size of the openings 140 of the base 30 and similarly function to locate the gamma ray sources 135 relative to the base 30 and, of course, selected ones of the irradiators 21–28, again as earlier described.

Accordingly, by virtue of the openings 74, 140 in the base 30, the associated probes 70, 134 and 137 of the respective irradiators 21–28 and the gamma ray sources 130, 135, and the selectivity of position afforded thereby through both selective positioning and relative rotation, the present invention provides virtually unlimited selectivity of radiation dosage irrespective of the particular radioisotopic sources being utilized (Cobalt-60 or Cesium-137), the speed of throughput of any particular irradiator or any number thereof, and irrespective of the manner in which the same are interconnected by the valved pneumatic conveyor system 20. For example, if it is assumed that of the eight irradiators 21–28 shown in FIG. 2, it is desired to expose the bulk material to minimum radiation dosage, the valves V1–V19 might be selectively positioned such that the bulk material would flow through the conduit L1 (FIG. 1), the main pneumatic manifold Cm, the pneumatic conveyor C4 and down the tubes 81–84 of the irradiator 24 followed by upward spiral movement by the screw conveyor 95 and subsequent discharge through the conduit 55, the conduit C8 and the conduit or line Ls. If, however, it were desired to increase the exposure time of the bulk material to gamma ray radiation without changing the speed of travel, the various valves V1–V19 could be selectively positioned such that the granular material leaving the manifold Cm would follow the same flow path last described except after leaving the irradiator 24 through the pneumatic conveyor C8 it would be directed by the valve V15, the valve V14 and the valve V13 into the pneumatic conveyor C3, downwardly into and outwardly up from the irradiator 23, into the conduit C7 and via the valves V13, V14, and V18 thereof to the conveyor Ls. Obviously, virtually any combination is possible insofar as utilizing any particular one or more of the irradiators 21–28 or the possible total of 16 irradiators which can be positioned upon the base 30 shown in FIG. 2. Obviously, much of this would depend upon the sophistication of the valved pneumatic conveyor system 20 and the control means therefore, but such is well known in prior art and forms no part of the invention other than that necessary to afford the selectivity of utilizing one or more and a variety of combinations of the various modular irradiators 21–28 of the overall irradiator system 10. Furthermore, due to the interconnection of the modular irradiators 21–28 afforded by the valved pneumatic conveyor system 20, should any one of the irradiators 21–28 become inoperative it can be bodily removed by simply connecting a chain or cable winch to the upper end 38 thereof which is, of course, exposed above ground level G (FIG. 1), disconnecting the various couplings at the uppermost ends of the tubes 51–55 and 58, closing whichever of the valves V1–V5 must be closed to cut off bulk material flow to the irradiator to be removed and then simply bodily removing the irradiator, substituting an operative stand-by modular irradiator therefor, or repairing the withdrawn inoperative irradiator, replacing the same, and placing it back into the system 20. Thus the modular irradiator concept not only provides efficient utilization of the radioactive sources (130 and/or 135) because of the two passes of the bulk material during a single irradiation stage, but this dosage can be increased (or decreased) by conveying the bulk material through others of the irradiators and by relatively positioning the irradiators and the radioactive sources relative to each other as afforded the openings 74, 140 of the base 30 and the projections or probes 70, 134, 137 to obtain optimum dosage. The throughput can also be increased or decreased simply by altering the speed of rotation of any one of the shafts 46 through the adjustable speed motor 44 associated with each irradiator 21–28. Thus the latter variables of the overall irradiator system 10 assures highly economic irradiation of bulk material, relatively uniform cross-sectional dosage thereof due to the spiral path of travel created by the screw conveyor 95, and maximum gamma ray absorption by the bulk material.

Reference is now made to FIG. 11 of the drawings which illustrates a modification in the structure for introducing pressurized air into an interior chamber 80' of an irradiator 24'. Structure of the irradiator 24' which is identical to the irradiator 24 is identified by primed numerals. Bulk granular material is delivered downwardly through a tube 82' and then upwardly through the interior chamber 80' by a screw conveyor 95' after which it is discharged in a fluidized condition through a discharge tube 55'. Pressurized air is delivered into the interior chamber 80' adjacent the discharge tube 55' by a tube 145 which is inside the tube 82' but opens into the interior chamber 80'. The tube 145 is suitably conventionally coupled to another tube, corresponding to the tube 58 of the irradiator 24 (see FIG. 7).

Another irradiator 24'' (FIG. 12) includes an interior chamber 80'', a screw conveyor 95'', and a tube 82'' through which bulk material can be delivered downwardly and into the interior chamber 80'' through an opening 92''. In this case a tube or pipe 146 is housed within and generally along the entire length of the tube 82'' and includes a plurality of outlet ports 147 opening radially inwardly into the interior chamber 92''. When air is delivered through the tube 146 it not only functions to fluidize the bulk material, but at the conclusion of an irradiation process, the air emitted from the nozzles or outlets 147 functions to blow the irradiated bulk material from otherwise stagnant areas and assures that the interior chamber 95'' is thoroughly cleansed or purged by the removal of all irradiated material. The latter is necessary because any material which remains in the interior chamber 80'' for an excessive length of time while the lower end portion 35 of the irradiator 24'' is in the irradiation zone (Z of FIG. 1), will become excessively irradiated and unsuited for its eventual end purposes. Obviously, as the pressurized air is emitted into the interior chamber 80'' by the outlets 147 the screw conveyor 95'' rotates and the air is evacuated through the conduit 55'' to draw all of the bulk material from the interior chamber 80'' and totally cleanse the interior thereof. If desired, tubes corresponding to the tube 146 and the outlets 147 can, of course, be incorporated in the remaining three tubes (not shown) corresponding to the tubes 81, 83 and 84 of the irradiator 24.

Another modular irradiator 24''' (FIG. 14) includes a plurality of tubes (83''', 84''' being shown) through which bulk material is fed downwardly into an interior chamber 80''' and then elevated spirally upwardly by a screw conveyor 95'''. The bulk material is fluidized by pressurized air introduced into an upper portion of the interior chamber 80''' through a tube or pipe 145''', and the fluidized bulk material is then evacuated through the pipe or tube 55'''.

As compared to the modular irradiator 24, the irradiator 24''' includes an upper end portion 156 defined by a relatively small diametered cylindrical housing or shell 157 having a lower flange 158 secured by bolts 160 to an upper end plate 162 which is welded to the cylindrical wall 60'''. An upper end of the housing 157 also includes a flange 163 which is secured by bolts 164 to a housing 165 having therein an appropriate gear reducing mechanism 166 which is driven by a variable speed A.C. or D.C. motor 167. An output drive 170 of the reduction gearing 166 is splined to a drive shaft 171 which in turn passes through an annular block of lead 172 which shields against irradiation streaming by absorbing gamma rays. The shaft 171 is in turn connected through a female splined connector 173 to another short shaft 174 which is in turn connected by a splined connection 175 to an upper end of a central tube or shaft 71''' of the screw conveyor 95'''. Appropriate conventional bearings 176 provide rotational support for the short shaft 174. The bearings 176 form water-tight seals with respect to the short shaft 174 and a neck 177 within which the bearings 176 are housed. A similar O-ring seal 178 is housed between the flange 158 and the plate 162. This water-tight relationship is required because the irradiator 24''' is designed to be immersed into a pool 11 (FIG. 1) in the manner heretofore described relative to the irradiators 21–28. However, in the latter irradiators the upper end portions 37 are not water-tight and, in fact, the openings 41 (FIGS. 1 and 7) permit water to flood the interior of the upper end portions 36 up to the upper water surface level LL. The water within the upper end portions 36 constitutes the gamma ray shielding in the irradiators 21–28 whereas in the irradiator 24''' the upper end portion 156 is air tight and the shielding is effected solely by the mass of lead 172. Thus, the relatively narrower diameter of the housing 157 of the irradiator 24''' as compared to the housing 37 of the upper end portion 36 of the irradiator 24, the rigid drive connection 173 (FIG. 14) versus the flexible drive 105 (FIG. 13), and lead versus water shielding are differences between the two irradiators 24, 24'''. In addition, the irradiator 24''' includes a plurality of short vanes or mixing paddles 180 (See particularly FIGS. 15 and 16) which are spaced along and protrude from the upper surface of a helix or screw 96''' of the screw conveyor 95'''. The paddles 180 are spaced approximately 120° from each other and radial faces 181 are in intimate engagement with the inner surface (unnumbered) of the cylindrical wall 60''' while uppermost faces 182 are slightly convexly curved or inclined. Thus, as the screw conveyor 95''' rotates under the influence of the motor 167 and the drive elements heretofore described, the bulk material is constantly agitated and material which might otherwise tend to accumulate radially outboard because of the rotational speed of the screw conveyor 95''' will be continuously displaced inwardly by the paddles 180, as indicated by the headed-unnumbered arrows in FIG. 16, to achieve uniform cross-sectional dosage.

In lieu of the paddles 180, a further concept of the invention utilizes paddles of the type conventionally used which are placed at a distance of about half way between adjacent flights on the screw conveyor 95'''. These paddles (not shown) are held to the shaft 71''' by appropriate bolts or welding, but are positioned at an angle to the motion provided by the rotation of the screw conveyor 95'''. In such a position these paddles then must pass through the material and cause some mixing. The paddles can extend outwardly to the periphery of a flight but do not engage or contact the interior surface of the cylindrical wall 60'''. Such paddles might be located at positions approximately 120° apart in an azimuth direction, but might only consist of three to five paddles throughout the entire axial length of the active screw portion of the screw 96''', that is the part in the irradiation zone.

Another modular irradiator is designated by the reference numeral 190 (FIG. 17 and 19) and is similar to the irradiator 24''' except for the manner in which bulk material is fed to a helical screw or screw conveyor and the manner in which the latter is driven or rotated. The modular irradiator 190 (FIGS. 17 and 19) includes a lower end portion 191 and an upper end portion 192. The lower end portion of the irradiator 190 includes a generally cylindrical shell or housing 193 closed at its bottom by a bottom wall 194 (FIG. 19) and at its top by a top wall 195. A screw conveyor 196 is housed within an interior chamber 197 and includes a tubular drive shaft 198 having a plurality of outlet openings 200 at a lower end (unnumbered) thereof. A thrust bearing 201 supports the tubular shaft 198 at its lower end upon the bottom wall 194 in a conventional manner, as was described earlier with respect to the elements 97, 98 and 100 of the irradiator 24 (FIG. 6). An upper end (also unnumbered) of the tubular shaft 198 carries a pair of diametrically opposite projections 202 which are engaged in conventional bayonet slots 203 (FIG. 17) in a lower end (unnumbered) of a hollow tubular shaft or tube 204 of the upper end portion 192. The tube 204 must have a smooth transition with the tubular shaft 198, as shown in FIG. 19, so as to prevent any possible mechanical holdup of the bulk material being conveyed downwardly. A helical vane or helical screw 205 is welded to the shaft 198 and during the rotation of the shaft 198 the granular material is elevated upwardly after having first been discharged radially outwardly through the outlet openings 200 after having descended through the shafts 204, 198 and a telescopic bulk material inlet tube 206. As the screw conveyor 196 is rotated by a drive mechanism 207, (at all times located above the upper liquid level LL of an associated pool 11, FIG. 1) in a manner to be described more fully hereinafter, the bulk material deposited upon the lowermost portions of the screw 205 are spirally elevated, subjected to gamma ray irradiation, subsequently fluidized by pressurized air introduced into the interior chamber 197 through a tube or pipe 208 and thereafter evacuated through a pipe or tube 210. Therefore, as compared to the irradiators 21–28, the tubes 81 84 have been eliminated and in lieu thereof the tubular shafts 71 have been transformed into the infeed bulk material conveyor by providing the outlet openings 200 in the tubular shaft 198 and, of course, appropriately connecting the same to the lines C1–C4 of the pneumatic conveyor system 20 (FIG. 1). However, the tubes 81–84 can as well be utilized with the tube 198 to collectively feed bulk material into interior chamber 197.

The tubes or tubular shafts 198, 204 not only convey the bulk material into the chamber 197 of the irradiator 190, but also cooperate to effect rotation of the conveyor screw 196 through the drive mechanism 207 which includes a housing 211 having walls 212, 213 carrying conventional bearings 214, 215, respectively. The bearings 214, 215 are in external telescopic relationship to the tubes 206, 204, respectively and conventional O-ring seals 216 are housed between telescopic portions (unnumbered) of the tubes 204, 206. A reversible variable speed motor 217 drives the shaft 218 suitably journalled in the housing 211 which carried a worm 220 in mesh with a gear or wheel 221 (FIG. 18) welded or otherwise fixed to the upper end (unnumbered) of the tube 204. The energization of the motor 217 rotates the shaft 218 which in turn rotates the worm or worm gear 220 which through the gear or worm wheel 221 rotates the tube 204 and hence the screw conveyor 196 connected thereto through the projections 202 and the bayonet slots 203. The rotation of the tube 204 is transmitted to the screw conveyor 196 to elevate the bulk material within the interior chamber 197.

Another irradiator system 230 is shown in FIG. 20 of the drawings and includes as a portion thereof an irradiator 190' which is identical to the irradiator 190 of FIGS. 17–19 and thus like reference numerals applied thereto have been primed to indicate similarity of structure. However, in lieu of the pool-type irradiation system described relative to the irradiator 190, the irradiator 190' is illustrated being utilized in a cell-type irradiator system 230 in which a gamma ray source 219 of a cylindrical configuration or array is normally housed submerged in a pool 11' with the water W' providing radiation shielding when the system 230 is inoperative (source 219' submerged). The system 230 is operative when the gamma ray source 219' is raised from the solid outline position below the water level LL' to the phantom outline position above the latter-noted water level and ground level G'. The latter movement is imparted to the gamma ray source 219 by suitable pulleys 231 (FIGS. 20 and 21) driven by a reversible variable speed motor 232 with the pulleys 231 having cables 233 entrained thereabout and appropriately connected to the gamma ray source 219. Electromagnetic clutches (not shown) of the motors 232 release on the loss of electrical power or through the activation of suitable interlocks which are broken as a result of unauthorized access to an associated irradiation zone such that the source 219, if above the level LL', would be able to drop under gravity back into the water W. In order to avoid injury to the gamma ray source 219 suitable dampers (not shown) could be utilized near the bottom of the pool in alignment with source 219 so that though the latter is returned under gravity it will be damped in its travel in the absence of large impact forces being generated.

The gamma ray source 219 and, more specifically, the rack (unnumbered) thereof carries guide shoes 234 which slide along and are guided by vertical upright guide rails 235. Once the gamma ray source 219 is in its uppermost (phantom line) position in FIG. 20 the lower end portion 191' of the irradiator 190' can be lowered by conventional hydraulic fluid motors 236, such as telescopic pistons and rods, supported from overhead beams 237, and irradiation of the bulk material can then take place as earlier described except in this case the same occurs under dry conditions, i.e. above the water level LL'.

The system 230 is also designed for a dual-purpose mode of operation by means of further conveyor means generally designated by the reference numeral 240 (FIGS. 20–22) which includes a conventional spiral roller conveyor 241 having an uppermost inlet or entrance end portion 242 and a lower outlet end portion 243 (FIGS. 20 and 21). The spiral conveyor 241 is suitably supported between the vertical supports or guides 235 and other vertical supports 245 (FIGS. 20 and 21). Packaged or loose material PM (FIGS. 21 and 22), such as crates of oranges, potatoes, cartons of bottle caps or closures, etc., are positioned upon the entrance end portion 242 of the spiral conveyor 241 and are simply gravity fed downwardly and subject to the gamma rays emitted by the gamma ray source 219' when the latter is in its operative elevated position (FIG. 22). The irradiated packaged material PM simply exits the spiral conveyor 241 at the outlet end portion 243 which is, of course, positioned above ground level G'. Normally the entire spiral conveyor 241 would be filled with the packaged material PM with each individual crate being in abutment with adjacent crates and thus it is necessary merely to regulate the removal of the packaged material PM at the outlet end portion 243 to control the rate of gravity feed of the packaged material PM downwardly along the spiral roller conveyor 241. Obviously, though the conveyor 241 has been illustrated and described as a gravity roller conveyor, the same can just as equally be a driven spiral conveyor, typical of luggage conveyors utilized at airports, in the baking industry, etc., such that positive drive and thus positive speed control can be afforded the packaged material PM during the descent thereof. Obviously, the latter type of driven conveyor, when coupled to a reversible motor, could be utilized to convey the packaged material PM, not only spirally downwardly, but also spirally upwardly. Thus the system 230 can be operated to either (1) irradiate only packaged material PM when the bulk irradiator 190' has been retracted (FIG. 20), or (2) irradiate both packaged material and bulk material (FIG. 22) or (3) simply irradiate only bulk material by not conveying packaged material PM along the spiral conveyor 241 while irradiating the bulk material when the lower portion 191' of the bulk irradiator 190' is positioned internally of the gamma ray source 219 (FIG. 22). Obviously, since gamma rays radiate from the source 219 both radially inwardly and radially outwardly therefrom, these can be most beneficially absorbed when both bulk and packaged material are being simultaneously irradiated by the system 230.

During the spiral ascent or descent of the packaged material PM upon the spiral conveyor 241 a side Sr (FIGS. 21 and 23) of the packaged material or crate PM facing inward toward the gamma ray source 219 would normally be closest thereto throughout its entire spiral travel. The opposite side So (FIGS. 21 and 23) of each packaged crate or packaged material PM would be furthest from the gamma ray source 219 during the same downward gravity descent upon the spiral conveyor 241. This would cause a steep radial gradient of absorbed radiation dose between the side Sr and the opposite side So. Obviously, uniform radiation absorption and a relatively low max to min ratio of the absorbed radiation dose throughout the packaged material PM is desirable, and such is achieved in the present irradiation system 230 by incorporating in or as part of the conveyor means 240 approximately mid-length of the spiral conveyor 241 thereof means 250 (FIGS. 22 and 23) for rotating each packaged material or crate PM through, for example 180°.

The rotating means 250 includes a generally circular ring 251 which carries five rollers 252 having upper surfaces (unnumbered) lying in the same plane as the upper surfaces of the adjacent rollers (unnumbered) forming the spiral roller conveyor 241. The circular ring 251 is mounted for rotation upon a support ring 253 which is suitably welded to or otherwise supported between inner and outer rails 254, 255, respectively, of the spiral roller conveyor 241. The ring 251 is provided with teeth 256 (FIG. 22) along its entire bottom periphery. The teeth 256 engage a gear 257 carried by a shaft (unnumbered) of an A.C. or D.C. motor 258 which is part of a control system (not shown) which includes a solenoid 260 (FIG. 23) for reciprocating an abutment arm 261 into and out of the path of travel of the packaged material PM as the latter descends along the spiral conveyor 241 toward the rotating means 250.

Each packaged material, carton or crate PM contacts and is stopped by the abutment arm 261 (FIG. 23) upstream of the rotating means 250, after which the solenoid 260 is operated to momentarily retract the arm 261. The crate PM then rolls upon the rollers 252 of the ring 251 and the motor 258 is energized to rapidly rotate the ring 251 through 180°. During the latter rotation the side Sr is rotated to the outside of the spiral conveyor 241, as is most readily apparent from FIG. 23, and the side So is rotated to the inside, thus interchanging the positions of the sides Sr and So. The thus rotated packaged crate PM continues its descent beyond the rotating means 250 and during the latter the side So is closer to the radiation source 219 (see FIG. 22) and the crate is thus subject to identical dosage for identical lengths of time with respect to the opposite sides Sr and So. This assures uniform radiation absorption of the packaged material PM and a relatively low max to min ratio of the absorbed radiation doses throughout the packaged material PM.

Obviously, while only the single rotating means or mechanism 250 has been disclosed or described, other such means can be positioned along the length of the spiral conveyor 241. For example, other identical rotating means 250 can be appropriately positioned along the spiral conveyor 241 to rotate each packaged material or crate PM through only 90° at each station, thus subjecting opposite sides of each four-sided crate PM to equal dosages during its travel between the end portions 242, 243 of the spiral conveyor 241.

Another irradiation system is shown in FIGS. 24 through 26 of the drawings, and is generally designated by the reference numeral 230′ with other numerals being primed to identify structure identical to the irradiator system 230 of FIGS. 21–23. The irradiator system 230′ includes conveyor means 240′ in the form of a spiral roller conveyor 241′ which surrounds a modular bulk irradiator 190″ and a cylindrical gamma ray source 219″. The bulk material irradiator 190″ and the gamma ray source 219″ are illustrated in FIG. 25 in the operative position corresponding to that shown in FIG. 22 relative to the irradiator system 230 at which time bulk material alone, packaged or loose material alone or both can be appropriately irradiated.

The irradiation system 230′ differs from the irradiation system 230 principally in the construction of the spiral conveyor 241′ which includes an inlet end portion 272 and an outlet end portion 273 which are generally adjacent each other at an uppermost position of the overall spiral conveyor 241′. The inlet end portion 272 merges and forms part of an inboard spiral conveyor portion 274 which is most immediately adjacent the cylindrical radiation source 219″, and after spirally enclosing the latter, terminates at a return and turn conveyor portion 275 disposed generally at the bottom of the overall spiral conveyor 241′. The return and turn conveyor portion 275 merges with and forms part of an outboard spiral conveyor portion 276 which is in exterior spiral surrounding relationship to the inboard spiral conveyor portion 274, is adjacent but immediately outboard thereof, and is axially offset therefrom, as is best illustrated in FIG. 26. The outboard spiral conveyor portion 276 merges at its upper end portion with the outlet end portion 273.

Due to the construction of the spiral conveyor 241′ and particularly the return and turn conveyor portion 275 (FIG. 24) and the axial offset relationship of the inboard spiral conveyor portion and the outboard spiral conveyor portion, 274 and 276 respectively, the packaged material PM is uniformly irradiated from both sides because of the return and turn conveyor portion 275. As is most apparent from FIG. 24, the return and turn conveyor portion 275 turns the packaged material PM from a position at which its face Sr is closest to the source of irradiation 219″ to a position at which the face Sr is furthest therefrom after each packaged material or crate PM passes beyond the return and the turn conveyor portion 275. Obviously, since the outboard spiral conveyor portion 276 is of an ascending nature at least this portion must be driven whereas the descending inboard spiral conveyor portion 274 can be simply be a gravity conveyor or it too can be appropriately conventionally driven.

The purpose of the axial offset relationship of the inboard and outboard spiral conveyor portions 274, 276, respectively, (FIG. 26) is to optimize radiation dosage in a radial outward direction from the gamma ray source 219″. The unnumbered headed arrows in FIG. 26 indicate that radial outward irradiation from the source 219″ which, if not absorbed by the packaged material PM upon the inboard spiral conveyor portion 274 would simply be wasted after passing therebeyond. However, since the packaged material PM is also on the outboard spiral conveyor portion 276 any such otherwise wasted radiation would be absorbed by the packaged material PM on the outboard spiral portion 276 thus increasing the overall efficiency of the irradiator system 230′. Thus, the irradiator system 230′ can be used to irradiate bulk material alone via the modular irradiator 190″, packaged material alone via the conveyor system 240′, or both. Furthermore should it be desired to increase the irradiation during the irradiation of packaged material only the modular irradiator 190″ can be lifted entirely outwardly from within the source of gamma rays 219″.

Instead of the single spiral conveyor 241′of FIGS. 24–26, two individual separate spiral conveyors can be utilized, one located inwardly close to the irradiator 190″ and the other external to the first, but each arranged to have rotating means or rotating tables, such as the rotating means 250, located at appropriate positions along the spiral conveyors so a to enable four sided irradiation of any packaged materials being conveyed. The two spiral conveyors can be independent or dependent of each other. If independent, each includes each separate inlet and outlet such that two independent conveyor lines are established for two different products whereas if dependent a product can be fed on the inner spiral conveyor from top to bottom and at the bottom be transferred to the outer spiral conveyor for subsequent discharge.

In all cases involving conveyors of the types heretofore described, the materials should be as light as possible and selected to minimize parasitic gamma ray absorption. However, the material should be equally highly radiation resistant and preferably made of metal.

Another irradiation system 280 (FIGS. 27 and 28) is designed for irradiating bulk material, palletized material or both bulk and palletized material much in the manner of the irradiation systems 230, 230′ heretofore described. The irradiation system 280 includes a bulk irradiator 190‴ and a cylindrical gamma ray source 219‴ corresponding to the like numbered and more specifically described elements of FIGS. 20–25. However, in lieu of the spiral conveyor means 240, 240′ and the associated spiral roller conveyors 241, 241′ thereof, respectively, the irradiator system 280 includes bulk material conveying, supporting and/or rotating means 285 positioned at generally the twelve o'clock, three o'clock, six o'clock and nine o'clock positions (FIGS. 27) relative to and radially outboard of both the bulk material conveyor 190‴ and the radiation source 219‴.

Each of the means 285 is positioned above ground level and at each of the twelve o'clock, three o'clock, six o'clock and nine o'clock positions includes rail means 290 and turntable means 295. The rail means 290 includes a first pair of upwardly grooved rails 291, 292 spaced from and in alignment with a second pair of upwardly grooved spaced parallel rails 293, 294, respectively.

Between the rails 291, 292 on the one hand and 293, 294 on the other is the turntable 295 which includes a generally circular plate 296 having an underside supported for rotation by a series of conventional bearings 297 (FIG. 28). An upper surface (unnumbered) of the circular plate 296 includes two intersecting pairs of grooves 301, 302 and 303, 304. The grooves 301–304 are in the same horizontal plane as the grooves (unnumbered) of the rails 291–294. Thus by rotating the plate 296, in the manner shown at the three o'clock position in FIG. 27, the pairs of grooves 301, 02 and 303, 304 can be selectively aligned with rails 291, 293 and the 292, 294 to define continuations thereof, as indicated at the twelve o'clock, six o'clock and nine o'clock positions. The circular plate 295 can be rotated, preferably through 90° increments, manually or automatically, and in the latter case a variabl speed reversible A. C. or D. C. motor 305 associated with each of the means 285 drives through its output shaft (unnumbered) a gear 306 which meshes with a ring of teeth 307 on the underside of the circular plate 296. The plate 296 supports the palletized material or crate PM by means of a skid or platform 310 carrying four round balls or casters 311 which are spaced from each other the distance between the grooves 301, 302; 303, 304 and the grooves (unnumbered) in the rails 291, 292 and 293, 294.

The underside (unnumbered) of each platform 310 is provided with a downwardly opening annular groove or channel 313 in which is received an upwardly directed nose 314 of a piston rod 315 reciprocally mounted in a fluid cylinder 316 at each of the twelve o'clock, three o'clock, six o'clock and nine o'clock positions. The cylinder 315 is connected to a suitable rigid support (not shown) and is connected to a pressurized hydraulic source and a reservoir in a conventional manner to selectively extend and retract the piston rod 315.

If it is desired to utilize the irradiation system 280 to irradiate palletized material or crates PM, such palletized material PM is first loaded atop any one or all of the platforms 310 after which the rods 315 are each extended to position the platforms 310 and the palletized material PM thereupon to the inboardmost positions adjacent the radiation source 219''', as shown by the platforms 310 at the twelve o'clock, six o'clock and nine o'clock positions. Once a desired irradiation dose has been effected, any one or all of the platforms 310 are then retracted by the retraction of the piston rods 315 to an intermediate position at which the casters 311 are supported in selected ones of the grooves 301–304 of the circular plate 296 after which the latter is rotated by energization of the motor 305. The rotation imparted thereto might be, for example, simply 90° after which the motor 305 is de-energized and each of the rods 315 is extended to move the palletized material PM back to the irradiation position closely adjacent the source 219''' but, of course, with another face position close thereto. By repeating this reciprocal and rotating process all four faces or sides (unnumbered) of the palletized material PM can be subject to optimum irradiation dosage at any one or all of the twelve o'clock, three o'clock, six o'clock and nine o'clock positions with or without also irradiating bulk material in the irradiator 190'''.

Another irradiator system **280*a* (FIG. 29) is identical to the irradiator system 280 and includes a modular bulk irradiator 190*a*, a circular or annular array of gamma ray source elements or radiation source 219*a* and conveying, supporting and/or rotating means 285*a*, 285*b*, 285*c* and 285*d* located at the twelve o'clock, three o'clock, six o'clock and nine o'clock positions, just as in the case of the irradiator system 280. However, it is apparent from FIG. 27 that gamma rays emitted radially outwardly from the source 219''' are wasted between the unoccupied areas or spaced between the four positions at which the palletized material PM is supported. However, in keeping with the irradiator system 280*a* of FIG. 29, these areas are occupied by further modular irradiators 190*b*, 190*c*, 190*d* and 190*e* (FIG. 29) through which bulk material can be conveyed and irradiated by gamma rays from the source 219'''** which might otherwise be wasted.

Another bulk irradiator system 300 (FIG. 30) includes a circular base 301, (FIG. 31) having a plurality of feet 302 designed to support the circular base 301 upon the bottom wall 13 (FIG. 1) of the pool 11. The base 301 includes a series of twelve openings 303 radially outboard of another set of twelve openings 304 and a center larger axial opening 305. The openings 303 function to receive projections (not shown), such as the projections 70 (FIG. 10) of a plurality of identical bulk material modular irradiators 306. The opening 305 of the base 301 likewise receives a projection of a central bulk material modular irradiator 307. The openings 304 of the base 301 receive projections corresponding to the projections 137 (FIGS. 4 and 5) of gamma ray sources 308 corresponding to those described earlier relative to FIGS. 4 and 5.

The irradiation system 300 is specifically designed for high volume throughput and to this end the modular irradiator 307 is relatively large in diameter and includes three contoured bulk material inlet tubes or conveyors 310 through 312 which open into the interior chamber (unnumbered) of the irradiator 307 in the same fashion heretofore described relative to the tubes 81–84 (FIGS. 9 and 12) of the irradiator 24. Similarly, a screw conveyor 313 conveys the bulk material spirally upwardly after which it is pneumatically conveyed from an upper end portion (unnumbered) of the interior chamber of the modular irradiator 307 through three conveyors or tubes 314–316 corresponding to the tube 55 of each of the irradiators 21–28.

Each of the twelve smaller diametered modular irradiators 306 includes an outermost contoured bulk material inlet tube 320 and at least one additional inboard bulk material inlet tube 321, the tubes 320, 321 again corresponding in purpose and function to any one of the tubes 81–84 for delivering bulk material into the interior chamber (unnumbered) of each irradiator 306 after which a screw conveyor 322 of each spirally elevates the bulk material during irradiation toward a discharge pipe or tube 323, again corresponding in structure and function to the pipe or tube 55 (FIG. 10). Those of the irradiators 306 immediately adjacent the bulk material inlet tubes 312 of the central irradiator 307 have only a single bulk material inlet tube 321, but a second bulk material inlet tube 324 can be provided those irradiators 306 positioned at the twelve o'clock, one o'clock, four o'clock, five o'clock, eight and nine o'clock positions to optimize the operation of the overall irradiator system 300. Thus, because of the intimate and/or concentric relationship of the irradiators 306, 307 and the radiation sources 308 a relatively high throughput rate can be obtained by the irradiator system 300.

Another example of a bulk material modular irradiator 300' is shown in FIG. 32, and structure corresponding to the irradiator system 300 of FIG. 30 has been identically numbered though primed. Thus, in this case the irradiation system 300' includes a single central modular irradiator 307' having three bulk material outlet tubes 314'–316' and virtually the same sized modular irradiators 307''' surround the irradiator 307' and have a single bulk material outlet 314''', although other outlets can be provided. The inlet tubes for the irradiators 307' and 307'' are generally designated by the reference numerals 310' and 321''. However, apart from the relative differences in sizes and configurations of the relative components thus far described, the irradiation system 300' utilizes as a radiation source a series of plaques or racks of radiation source elements which are generally designated by the reference numeral 330. These gamma ray sources 330 correspond identically to the sources 130 of FIG. 3 heretofore described, and projections thereof (not shown) are received in openings (not shown) of a base 301' to locate the sources 330 as illustrated. Obviously, apart from the differences in the arrangement in sizes of the irradiation systems 300, 300', the principal difference between the two is that Cobalt-60 sources 330 are used in the irradiation system 300' rather than Cesium-137 sources 308 of the irradiation system 300. The six planar or rack sources 330 of Cobalt-60 provide a much higher dose rate and thus larger (approximately 3 foot diameter) irradiators 307'' can be utilized as opposed to the relatively smaller (18 inch irradiators 306 of the system 300. Obviously, it is also much easier to remove and reinsert the planar radiation sources 330 than the smaller and more numerous radiation sources 308. Furthermore, though both irradiator systems 300 and 300' are designed primarily for use in pool irradiators, they are also equally adapted for use in dry types of cell irradiators.

Variations in the various preferred embodiments of the invention thus far described will be apparent to those skilled in the art, and among those might include, for example, the utilization of a plurality of short vanes or mixing paddles in lieu of the paddles or vanes 180 heretofore described relative to the irradiator 24''' (FIGS. 14–16). As additions to or in lieu of the mixing vanes or paddles 180, a plurality of radially outwardly directed paddles are welded or bolted to the shaft 71''' (FIG. 14) at a distance of about half-way between adjacent flights of the screw 96'''. Preferably, the paddles are placed at an angle to the rotary motion provided by the screw 96''' so that these paddles pass through the material during rotation of the shaft 71''' and cause some mixing. Such paddles can extend radially outward toward the inner periphery of the cylindrical wall 60''' but do not engage the same. Such paddles can be located at positions approximately 120° apart in an azimuth direction but might only consist of three to five paddles throughout the entire axial length of the active screw portion, that is that portion in the irradiation zone.

It is also important in the operation of the various bulk irradiators heretofore described that the material which is conveyed upwards by the associated screw conveyor does not fall backward or downward to lower elevations and thus be reirradiated as it moves through the irradiation zone. The screw conveyors not only elevate the bulk material during the rotation of the flight thereof, but also move the bulk material radially outwardly which if otherwise unconfined might fall downwardly between any gap between the peripheral edge (unnumbered) of a particular screw and its associated cylindrical housing. In order to avoid the latter means it must be utilized at the outer edge of the continuous flight of the screw conveyor so as to minimize the bulk material falling backwardly under gravity, and one way of accomplishing this is to provide a groove (not shown) in the screw 205 (FIG. 19) for example, at the outer edge thereof which opens upwardly and into which can be inserted a material such as nylon or neophrene rubber or any other highly radiation resistant material, including even the use of metal. In the latter case preferably impregnated metal, such as impregnated aluminum or other types of metal, can be provided to provide relatively low coefficient of friction between the material and the inner surface of the confining cylinder. This strip of material would run the entire outer helical periphery of the screw 205 and thereby define a seal bearing against the inner surface of the cylinder to prevent bulk material from dropping back into the irradiation zone.

Another system for preventing bulk material from falling down and back into the irradiation zone would be the utilization of a helical tube welded to the underside of the screw 205 and having a plurality of apertures along the upper surface thereof directed upwardly into whatever gap may exist between the peripheral edge of the screw 205 and the inner surface of the cylinder 197 (FIG. 19). This tube could be connected in a conventional manner through a universal joint coupling to a source of pressurized air which when directed upwardly through the perforations thereof would continuously prevent the bulk material from falling between any space that might exist between the peripheral edge of the screw 205 and the cylinder inner surface. A variation of this concept would be that of utilizing a like tube attached to the upper edge of the screw 205 or alternatively a plurality of radial tubes along the bottom of the screw 205 which directs air under pressure to the outer edge of the screw 205 such that an overall pressure gradient in the entire interior of the cylinder 197 would be in an upward direction. In this manner there would be a continuous upwardly flowing air stream along the entire outer edge of the screw or flight 205 preventing backflow of bulk material and undesired reirradiation thereof.

Although in a preferred embodiment of the invention as has been specifically illustrated and described herein, it is to be understood that minor variations may be made in the apparatus and the method without departing from the spirit and scope of the invention, as defined in the appended claims.

What is claimed is:

1. A modular irradiator comprising a plurality of individual substantially self-contained modular conveyor units, means for conveying solid material in granular form to be irradiated continuously into, through and out of each conveyor unit, a plurality of gamma ray source means exteriorly of said conveyor units spaced from each other for subjecting the conveyed material to gamma rays, a plurality of means for selectively locating said plurality of conveyor units in any one of a plurality of different spatial relationships relative to each other and to said plurality of gamma ray source means, and a plurality of means for selectively locating said gamma ray source means in any of a plurality of different spatial relationships dependent upon at least one of (a) the selected locations of said conveyor units and (b) the dosage requirements of the material to be irradiated.

2. The modular irradiator as defined in claim 1 wherein said plurality of locating means each includes complementary male and female locating elements carried one by each of said conveyor units and the remainder by a locating surface of said irradiator.

3. The modular irradiator as defined in claim 1 wherein said gamma ray source means are selectively either individual cylindrical gamma ray source elements or a single rack housing a plurality of individual cylindrical gamma ray source elements, at least two of said conveyor units are arranged in adjacent spaced relationship, and means for selectively locating either an individual source element or a single rack thereof between said two conveyor units.

4. The modular irradiator as defined in claim 1 wherein each conveyor unit includes a chamber defined by a generally cylindrical wall, and each conveying means includes first conveyor means for directing material generally downwardly and exteriorly of said cylindrical wall and second conveyor means for directing material generally upwardly and interiorly of said cylindrical wall.

5. The modular irradiator as defined in claim 1 wherein each conveyor unit includes a chamber defined by a generally cylindrical wall, each conveying means includes first conveyor means for directing material generally downwardly and exteriorly of said cylindrical wall and second conveyor means for directing material generally upwardly and interiorly of said cylindrical wall, and said second conveyor means includes a screw.

6. The modular irradiator as defined in claim 1 wherein each conveyor unit includes a chamber defined by a generally cylindrical wall, each conveying means includes first conveyor means for directing material generally downwardly and exteriorly of said cylindrical wall and second conveyor means for directing material generally upwardly and interiorly of said cylindrical wall, and said first conveyor means is a substantially vertical tube through which the material descends.

7. The modular irradiator as defined in claim 1 wherein each conveyor unit includes a chamber defined by a generally cylindrical wall, each conveying means includes first conveyor means for directing material generally downwardly and exteriorly of said cylindrical wall and second conveyor means for directing material generally upwardly and interiorly of said cylindrical wall, said second conveyor means includes a screw for elevating the material, and third pneumatic conveyor means for conveying irradiated material beyond said second conveyor means.

8. The modular irradiator as defined in claim 1 wherein each conveyor unit includes a chamber defined by a generally cylindrical wall, each conveying means includes first conveyor means for directing material generally downwardly and exteriorly of said cylindrical wall and second conveyor means for directing material generally upwardly and interiorly of said cylindrical wall, said first conveyor means is a substantially vertical tube through which the material descends to a bottom portion of said chamber, and said second conveyor means includes a screw for elevating the material toward a top of said chamber.

9. The modular irradiator as defined in claim 1 wherein said base support means support said conveyor units in a generally upright substantially vertical position, and said plurality of locating means each includes complementary male and female locating elements carried one by each of said conveyor units and the remainder by said base support means.

10. The modular irradiator as defined in claim 1 wherein said base support means support said conveyor units in a generally upright substantially vertical position, said plurality of locating means each includes complementary male and female locating elements carried one by each of said conveyor units and the remainder by said base support means, and the remainder of said locating elements are positioned a substantially equal distance from each other.

11. The modular irradiator as defined in claim 1 wherein said base support means support said conveyor units in a generally upright substantially vertical position, said plurality of locating means each includes complementary male and female locating elements carried one by each of said conveyor units and the remainder by said base support means, and the remainder of said locating elements are positioned in a generally regular repetitive pattern upon said base support means.

12. The modular irradiator as defined in claim 1 wherein said base support means support said gamma ray source means in a generally upright substantially vertical position, and said gamma ray source locating means each includes complementary male and female locating elements carried one by each of said gamma ray source means and the remainder by said base support means.

13. The modular irradiator as defined in claim 1 wherein said base support means support said gamma ray source means in a generally upright substantially vertical position, said gamma ray source locating means each includes complementary male and female locating elements carried one by each of said gamma ray source means and the remainder by said base support means, and the remainder of said gamma ray source locating means are positioned a substantially equal distance from each other.

14. The modular irradiator as defined in claim 1 wherein said base support means support said gamma ray source means in a generally upright substantially vertical position, said gamma ray source locating means each includes complementary male and female locating elements carried one by each of said gamma ray source means and the remainder by said base support means, and the remainder of said gamma ray locating means are positioned in a substantially regular repetitive pattern upon said base support means.

15. The modular irradiator as defined in claim 3 wherein said base support means support said individual source elements and said single rack in generally upright substantially vertical positions, said locating means includes complementary male and female locating elements carried one by each individual source element and at least another one by said single rack and the remainder by said base support means, and the remainder of said locating means are disposed along a line between and generally tangential to said two conveyor units.

16. The modular irradiator as defined in claim 3 wherein said base support means support said individual source elements and said single rack in generally upright substantially vertical positions, said locating means includes complementary male and female locating elements carried one by each individual source element and at least another one by said single rack and the remainder by said base support means, the remainder of said locating means are disposed along a line between and generally tangential to said two conveyor units, said male locating elements are defined by at least one locating projection carried by each individual source element and single rack, and said female locating elements are a plurality of recesses of said base support means.

17. The modular irradiator as defined in claim 3 wherein said base support means support said individual source elements and said single rack in generally upright substantially vertical positions, said locating means includes complementary male and female locating elements carried one by each individual source element and at least another one by said single rack and the remainder by said base support means, the remainder of said locating means are disposed along a line between and generally tangential to said two conveyor units, and the remainder of said locating means are a plurality of recesses of said base support means.

18. The modular irradiator as defined in claim 3 wherein said base support means support said individual source elements and said single rack in generally upright substantially vertical positions, said locating means includes complementary male and female locating elements carried one by each individual source element and at least another one by said single rack and the remainder by said base support means, the remainder of said locating means are disposed along a line between and generally tangential to said two conveyor units, and the remainder of said locating elements are positioned in a generally regular repetitive pattern upon said base support means.

19. A modular irradiator comprising a plurality of individual substantially self-contained conveyor units, means for conveying material to be irradiated through each conveyor unit, a plurality of gamma ray source means spaced from each other for subjecting the conveyed material to gamma rays, a plurality of means for selectively locating said plurality of conveyor units in any one of a plurality of different spatial relationships relative to each other and to said plurality of gamma ray source means, and means for effecting eccentric repositioning of at least one of said conveyor units relative to base support means to vary its position relative to said gamma ray source means.

20. The modular irradiator as defined in claim 19 wherein said base support means support said conveyor units in a generally upright substantially vertical position, said eccentric repositioning means includes complementary male and female internested elements carried one by said one conveyor unit and the other by said base support means, said one conveyor unit having a central axis, and said one internested element having an axis parallel to but offset from said central axis.

21. The modular irradiator as defined in claim 19 wherein said base support means support said conveyor units in a generally upright substantially vertical position, said eccentric repositioning means includes complementary male and female internested elements carried one by said one conveyor unit and the other by said base support means, said one conveyor unit having a central axis, said one internested element having an axis parallel to but offset from said central axis, said one internested element is defined by a projection carried by said one conveyor unit, and said other internested element is a recess of said base support means.

22. A modular irradiator comprising a plurality of individual substantially self-contained conveyor units, means for conveying material to be irradiated through each conveyor unit, a plurality of gamma ray source means spaced from each other for subjecting the conveyed material to gamma rays, a plurality of means for selectively locating said plurality of conveyor units in any one of a plurality of different spatial relationships relative to each other and to said plurality of gamma ray source means, and means for effecting eccentric repositioning of at least one of said gamma ray source means relative to base support means to vary its position relative to said conveyor units.

23. The modular irradiator as defined in claim 22 wherein said base support means support said at least one gamma ray source means in a generally upright substantially vertical position, said eccentric repositioning effecting means includes complementary male and female internested elements carried one by said at least one gamma ray source means and the other by said base support means, said at least one gamma ray source means having a central axis, and said one internested element having an axis parallel to but offset from said central axis.

24. The modular irradiator as defined in claim 22 wherein said base support means support said at least one gamma ray source means in a generally upright substantially vertical position, said eccentric repositioning means includes complementary male and female internested elements carried one by said at least one gamma ray source means and the other by said base support means, said at least one gamma ray source means having a central axis, said one internested element having an axis parallel to but offset from said central axis, said one internested element is defined by a projection carried by said one conveyor unit, and said other internested element is a recess of said base support means.

25. A modular irradiator comprising a plurality of individual substantially self-contained conveyor units, means for conveying material to be irradiated through each conveyor unit, a plurality of gamma ray source means spaced from each other for subjecting the conveyed material to gamma rays, a plurality of means for selectively locating said plurality of conveyor units in any one of a plurality of different spatial relationships relative to each other and to said plurality of gamma ray source means, and means for effecting eccentric repositioning of at least one of said conveyor units and one of said gamma ray source means relative to base support means to vary the positions thereof relative to each other and remaining gamma ray means and conveyor units.

26. The modular irradiator as defined in claim 25 wherein said base support means support each said at least one gamma ray source means and said one conveyor unit in a generally upright substantially vertical position, said eccentric repositioning means includes complementary male and female internested elements carried one by each of said at least one gamma ray source means and said one conveyor unit and the others by said base suppport means, said at least one gamma ray source means and one conveyor unit each having a central axis, and each said one internested element having an axis parallel to but offset from its associated central axis.

27. The modular irradiator as defined in claim 25 wherein said base support means support each said at least one gamma ray source means and said one conveyor unit in a generally upright substantially vertical position, said eccentric repositioning means includes complementary male and female internested elements carried one by each of said at least one gamma ray source means and said one conveyor unit and the others by said base suppport means, said at least one gamma ray source means and one conveyor unit each having a central axis, each said one internested element having an axis parallel to but offset from its associated central axis, each said one internested element is defined by a projection carried by each said one gamma ray source means and said one conveyor unit, and said other internested elements are recesses of said base support means.

28. A modular irradiator comprising a plurality of individual substantially self-contained conveyor units, means for conveying material to be irradiated through each conveyor unit, a plurality of gamma ray source means spaced from each other for subjecting the conveyed material to gamma rays, and means for effecting eccentric repositioning of at least one of said conveyor units relative to base support means to vary its position relative to said gamma ray source means.

29. The modular irradiator as defined in claim 28 wherein said base support means support said conveyor units in a generally upright substantially vertical position, said eccentric repositioning means includes complementary male and female internested elements carried one by said conveyor unit and the other by said base support means, said one conveyor unit having a central axis, and said one internested element having an axis parallel to but offset from said central axis.

30. The modular irradiator as defined in claim 28 wherein said base support means support said conveyor units in a generally upright substantially vertical position, said eccentric repositioning means includes complementary male and female internested elements carried one by said conveyor unit and the other by said base support means, said one conveyor unit having a central axis, said one internested element having an axis parallel to but offset from said central axis, said one internested element is defined by a projection carried by said one conveyor unit, and said other internested element is a recess of said base support means.

31. A modular irradiator comprising a plurality of individual substantially self-contained conveyor units, means for conveying material to be irradiated through each conveyor unit, a plurality of gamma ray source means spaced from each other for subjecting the conveyed material to gamma rays, and means for effecting eccentric repositioning of at least one of said gamma ray source means to vary its position relative to said conveyor units.

32. The modular irradiator as defined in claim 31 wherein said base support means support said at least one gamma ray source means in a generally upright substantially vertical position, said eccentric repositioning means includes complementary male and female internested elements carried one by said at least one gamma ray source means and the other by said base support means, said at least one gamma ray source means having a central axis, and said one internested element having an axis parallel to but offset from said central axis.

33. The modular irradiator as defined in claim 31 wherein said base support means support said at least one gamma ray source means in a generally upright substantially vertical position, said eccentric repositioning means includes complementary male and female internested elements carried one by said at least one gamme ray source means and the other by said base support means, said at least one gamma ray source means having a central axis, said one internested element having an axis parallel to but offset from said central axis, said one internested element is defined by a projection carried by said one gamma ray source means, and said other internested element is a recess of said base support means.

34. The modular irradiator as defined in claim 31 wherein said means for effecting eccentric repositioning of at least one of said conveyor units to vary its position relative to said gamma ray source means.

35. The modular irradiator as defined in claim 34 wherein said base support means support said conveyor units in a generally upright substantially vertical position, said eccentric repositioning means includes complementary male and female internested elements carried one by said one conveyor unit and the other by said base support means, said one conveyor unit having a central axis, and said one internested element having an axis parallel to but offset from said central axis.

36. The modular irradiator as defined in claim 34 wherein said base support means support said at least one gamma ray source means in a generally upright substantially vertical position, said eccentric repositioning means includes complementary male and female internested elements carried one by said at least one gamma ray source means and the other by said base support means, said at least one gamma ray source means having a central axis, and said one internested element having an axis parallel to but offset from said central axis.

37. A conveyor unit particularly adapted for utilization in modular irradiator comprising a generally upright cylindrical wall defining an interior chamber, first conveyor means for directing material generally downwardly of said cylindrical wall, second conveyor means for directing material generally upwardly and interiorly of said cylindrical wall, said first conveyor means being a substantially vertical tube through which the material is adapted to descend, said second conveyor means being a screw for elevating the material, a second cylindrical wall disposed above said first cylindrical wall, means for connecting said cylindrical walls to each other, a drive shaft for said screw, said drive shaft having shaft portions within each of said first and second cylindrical walls, and means for introducing irradiator pool water into said second cylindrical wall to prevent radiation steaming.

38. A conveyor unit particularly adapted for utilization in modular irradiator comprising a generally upright cylindrical wall defining an interior chamber, first conveyor means for directing material generally downwardly of said cylindrical wall, second conveyor means for directing material generally upwardly and interiorly of said cylindrical wall, said first conveyor means being a substantially vertical tube through which the material is adapted to descend, said second conveyor means being a screw for elevating the material, a second cylindrical wall disposed above said first cylindrical wall, said second cylindrical wall defining a second liquid tight interior chamber, means for connecting said cylindrical walls to each other, a drive shaft for said screw, said drive shaft having shaft portions within each of said first and second cylindrical walls, and gamma ray shielding means between said second cylinder wall and the shaft portion therein to prevent radiation steaming.

39. A conveyor unit particularly adapted for utilization in modular irradiator comprising a generally upright cylindrical wall defining an interior chamber, first conveyor means for directing material generally downwardly of said cylindrical wall, second conveyor means for directing material generally upwardly and interiorly of said cylindrical wall, said first conveyor means being a substantially vertical tube through which the material is adapted to descend, said second conveyor means being a screw for elevating the material, a second cylindrical wall disposed above said first cylindrical wall, means for connecting said cylindrical walls to each other, a second vertical tube extending along said second cylindrical wall, said tubes being in fluid communication such that material adapted to be delivered to said second tube above irradiator water pool level is delivered to said first tubes for irradiation thereof, a third vertical tube extending along said second cylindrical wall and opening into an upper portion of said interior chamber, pneumatic conveyor means for conveying irradiated material upwardly through said tube, means for fluidizing material in the interior chamber upper portion to facilitate its flow by said pneumatic conveyor means, and means for emitting gamma rays adjacent said first cylindrical wall and below said second cylindrical wall.

40. A modular irradiator comprising a generally cylindrical wall defining an interior chamber through which material to be irradiated is adapted to pass during irradiation thereof, means for subjecting the conveyed material to gamma rays, first conveyor means for directing material generally downwardly and interiorly of said cylindrical wall, second conveyor means for directing material generally upwardly and interiorly of said cylindrical wall, said first conveyor means being a tube having means for discharging material adjacent a lower portion of said interior chamber, said second conveyor means being a screw carried by said tube, and means for rotating said tube in a direction to rotate said screw to elevate the material upwardly from said interior chamber lower portion.

41. The modular irradiator as defined in claim 40 including a fill tube disposed in axial sliding and rotational relationship relative to said first-mentioned tube.

42. The modular irradiator as defined in claim 40 including pneumatic conveyor means for conveying irradiated material outwardly from an upper portion of said interior chamber.

43. The modular irradiator as defined in claim 40 including pneumatic conveyor means for conveying irradiated material outwardly from an upper portion of said interior chamber, and means for fluidizing the material in the interior chamber upper portion to facilitate its flow by said pneumatic conveyor means.

44. An irradiator for irradiating both bulk and/or packaged material comprising a generally upright cylindrical wall defining an interior chamber, first conveyor means for directing granular or powdered bulk material generally downwardly of said cylindrical wall, second conveyor means for directing the granular or powdered bulk material generally upwardly and interiorly of said cylindrical wall, third conveyor means for conveying packaged material around the exterior of said cylindrical wall, and means between said cylindrical wall and said third conveyor means for subjecting the conveyed material to gamma rays during the movement thereof by at least one of said first, second and third conveyor means.

45. The irradiator as defined in claim 44 wherein said gamma ray means are disposed inwardly of said third conveyor means.

46. The irradiator as defined in claim 44 wherein said gamma ray means are disposed between said third conveyor means and said first conveyor means.

47. The irradiator as defined in claim 44 wherein said gamma ray means are disposed between said third conveyor means and said second conveyor means.

48. The irradiator as defined in claim 44 wherein said gamma ray means are disposed between said third conveyor means and said first and second conveyor means.

49. The irradiator as defined in claim 44 wherein said third conveyor means is a spiral conveyor.

50. The irradiator as defined in claim 44 wherein said gamma ray means are disposed between and in surrounding relationship to said third conveyor means and said first conveyor means.

51. An irradiator for irradiating palletized material comprising a generally centralized cylindrical array source of gamma ray radiation, means for supporting palletized material at a plurality of positions spaced arcuately about said centralized cylindrical array gamma ray source, means for mounting said supporting means for reciprocal motion and rotational motion relative to said centralized cylindrical array gamma ray source such that opposite sides of palletized material upon said supporting means can be appropriately manipulated with respect to said centralized cylindrical array gamma ray source to effect desired dosage, and a bulk material conveyor positioned within said centralized cylindrical array gamma source.

52. The irradiator as defined in claim 51 wherein said bulk material irradiator comprising a generally upright cylindrical wall defining an interior chamber, first conveyor means for directing granular or powdered bulk material generally downwardly of said cylindrical wall, and second conveyor means for directing the granular bulk material generally upwardly and interiorly of said cylindrical wall such that said granular bulk material is irradiated by said centralized cylindrical array gamma ray source simultaneously with or in lieu of the irradiation of palletized material upon said supporting means.

53. The irradiator as defined in claim 52 wherein said centralized cylindrical array gamma ray source is disposed in external sandwiched relationship between said supporting means and said bulk material irradiator.

54. The irradiator as defined in claim 52 wherein said centralized cylindrical array gamma ray source is disposed in generally external encircling relationship to said bulk material irradiator inboard of said supporting means.

55. The irradiator as defined in claim 51 wherein said bulk material irradiator comprising a generally upright cylindrical wall defining an interior chamber, first conveyor means for directing granular bulk material generally downwardly of said cylindrical wall, second conveyor means for directing the granular or powdered bulk material generally upwardly and interiorly of said cylindrical wall such that said granular bulk material is irradiated by said centralized cylindrical array gamma ray source simultaneously with or in lieu of the irradiation of palletized material upon said supporting means and said first conveyor means is a substantially vertical tube.

56. The irradiator as defined in claim 51 wherein said bulk material irradiator comprising a generally upright cylindrical wall defining an interior chamber, first conveyor means for directing granular or powdered bulk material generally downwardly of said cylindrical wall, second conveyor means for directing the granular or powdered bulk material generally upwardly and interiorly of said cylindrical wall such that said granular or powdered bulk material is irradiated by said centralized cylindrical array gamma ray source simultaneously with or in lieu of the irradiation of palletized/packaged material upon said supporting means, and said second conveyor means includes a screw.

57. The irradiator as defined in claim 51 wherein said bulk material irradiator comprising a generally upright cylindrical wall defining an interior chamber, first conveyor means for directing granular or powdered bulk material generally downwardly of said cylindrical wall, second conveyor means for directing the granular or powdered bulk material generally upwardly and interiorly of said cylindrical wall such that said granular or powdered bulk material is irradiated by said centralized cylindrical array gamma ray source simultaneously with or in lieu of the irradiation of palletized material upon said supporting means, said second conveyor means includes a screw, and third pneumatic conveyor means for conveying irradiated granular or powdered bulk material beyond said second conveyor means.

58. The irradiator as defined in claim 51 wherein said bulk material irradiator comprising a generally upright cylindrical wall defining an interior chamber, first conveyor means for directing granular or powdered bulk material generally downwardly of said cylindrical wall, second conveyor means for directing the granular or powdered bulk material generally upwardly and interiorly of said cylindrical wall such that said granular or powdered bulk material is irradiated by said centralized cylindrical array gamma ray source simultaneously with or in lieu of the irradiation of palletized material upon said supporting means, said first conveyor means is a substantially vertical tube through which granular or powdered bulk material descends to a bottom portion of said interior chamber, and said second conveyor means includes a screw for elevating the granular or powdered bulk material toward a top of said interior chamber.

59. The irradiator as defined in claim 58 wherein said centralized cylindrical array gamma ray source is disposed in sandwiched relationship between said supporting means and said bulk material irradiator.

60. The irradiator as defined in claim 58 wherein said centralized cylindrical array gamma ray source is disposed in generally external encircling relationship to said bulk material irradiator inboard of said supporting means.

61. The irradiator as defined in claim 51 wherein said centralized cylindrical array gamma ray source is disposed in sandwiched relationship between said supporting means and said bulk material irradiator.

62. The irradiator as defined in claim 51 wherein said centralized cylindrical array gamma ray source is disposed in generally external encircling relationship to said bulk material irradiator inboard of said supporting means.

63. The irradiator as defined in claim 51 including at least another bulk irradiator positioned outboard of said centralized cylindrical array gamma ray source and between an adjacent pair of said supporting means.

64. The irradiator as defined in claim 57 including at least another bulk irradiator positioned outboard of said centralized cylindrical array gamma ray source and between each adjacent pair of said supporting means.

65. The irradiator as defined in claim 63 wherein said first and another bulk material irradiators each include a generally upright cylindrical wall defining an interior chamber, first conveyor means for directing granular or powdered bulk material generally downwardly of said cylindrical wall, and second conveyor means for directing the granular or powdered bulk material generally upwardly and interiorly of said cylindrical walls such that said granular or powdered bulk material is irradiated by said centralized cylindrical array gamma ray source simultaneously with or in lieu of the irradiation of palletized material upon said supporting means.

66. The irradiator as defined in claim 63 wherein said first and another bulk material irradiators each include a generally upright cylindrical wall defining an interior chamber, first conveyor means for directing granular or powdered bulk material generally downwardly of said cylindrical wall, second conveyor means for directing the granular or powdered bulk material generally upwardly and interiorly of said cylindrical walls such that said granular or powdered bulk material is irradiated by said centralized cylindrical array gamma ray source simultaneously with or in lieu of the irradiation of palletized material upon said supporting means, each said second conveyor means includes a screw, and third pneumatic conveyor means for conveying irradiated granular or powdered bulk material beyond each said second conveyor means.

67. The irradiator as defined in claim 63 wherein said first and another bulk material irradiators each include a generally upright cylindrical wall defining an interior chamber, first conveyor means for directing granular or powdered bulk material generally downwardly of said cylindrical wall, second conveyor means for directing the granular or powdered bulk material generally upwardly and interiorly of said cylindrical walls such that said granular or powdered bulk material is irradiated by said centralized cylindrical array gamma ray source simultaneously with or in lieu of the irradiation of palletized material upon said supporting means, said first conveyor means is a substantially vertical tube through which granular or powdered bulk material descends to a bottom portion of each said interior chamber, and each said second conveyor means includes a screw for elevating the granular or powdered bulk material toward a top of said interior chamber.

68. The irradiator as defined in claim 65 wherein said centralized cylindrical array gamma ray source is disposed in external sandwiched relationship between said supporting means and said first-mentioned bulk material irradiator.

69. The irradiator as defined in claim 65 wherein said centrallized cylindrical array gamma ray source is disposed in generally external encircling relationship to said bulk material irradiator inboard of said supporting means.

70. A modular irradiator comprising a plurality of individual substantially self-contained conveyor units, base support means for supporting said conveyor units in a generally upright substantially vertical position, each conveyor unit being defined by a generally upright cylindrical wall defining an interior chamber, first conveyor means associated with each cylindrical wall for directing material generally downwardly thereof, second conveyor means internally of each interior chamber for directing material generally upwardly and interiorly thereof, each first conveyor means being at least one substantially vertical tube associated with each cylindrical wall through which the material is adapted to descend, each second conveyor means being a screw in each interior chamber for elevating the material, at least one of said conveyor units being externally encircled by the remainder of said conveyor units, means for locating said conveyor units in said last-mentioned spatial relationship to each other, said locating means being a plurality of complementary male and female locating elements carried one by each of said conveyor units and the remainder by said base supporting means, and a plurality of individual gamma ray sources disposed in generally exterior encircling relationship to said one conveyor unit and generally exteriorly and inboard of the remainder of said conveyor units.

71. The modular irradiator as defined in claim 70 wherein said individual gamma ray sources are cylindrical.

72. The modular irradiator as defined in claim 70 wherein said individual gamma ray sources are planar.

73. The modular irradiator as defined in claim 70 wherein at least one of said gamma ray sources is in sandwiched relationship between two of said vertical tubes.

74. The modular irradiator as defined in claim 70 wherein at least one of said gamma ray sources is in sandwiched relationship between two of said vertical tubes of the same cylindrical wall.

75. The modular irradiator as defined in claim 70 wherein at least one of said gamma ray sources is in sandwiched relationship between two of said vertical tubes of said one conveyor unit cylindrical wall.

76. The modular irradiator as defined in claim 76 wherein at least one of said gamma ray sources is in sandwiched relationship between two of said vertical tubes of one of said remainder conveyor unit cylindrical wall.

77. A modular irradiator comprising a plurality of individual substantially self-contained conveyor units, base support means for supporting said conveyor units in a generally upright substantially vertical position, each conveyor unit being defined by a generally upright cylindrical wall defining an interior chamber, first conveyor means associated with each cylindrical wall for directing material generally downwardly thereof, second conveyor means internally of each interior chamber for directing material generally upwardly and interiorly thereof, each first conveyor means being at least one substantially vertical tube associated with each cylindrical wall through which the material is adapted to descend, each second conveyor means being a screw in each interior chamber for elevating the material, at least one of said conveyor units being externally encircled by the remainder of said conveyor units, means for locating said conveyor units in said last-mentioned spatial relationship to each other, said locating means being a plurality of complementary male and female locating elements carried one by each of said conveyor units and the remainder by said base supporting means, and a plurality of individual gamma ray sources disposed in generally exterior encircling relationship to said one conveyor unit and generally exteriorly and inboard of the remainder of said conveyor units, and the remainder of said locating elements are positioned a substantially equal distance from each other.

78. A modular irradiator comprising a plurality of individual substantially self-contained conveyor units, base support means for supporting said conveyor units in a generally upright substantially vertical position, each conveyor unit being defined by a generally upright cylindrical wall defining an interior chamber, first conveyor means associated with each cylindrical wall for directing material generally downwardly thereof, second conveyor means internally of each interior chamber for directing material generally upwardly and interiorly thereof, each first conveyor means being at least one substantially vertical tube associated with each cylindrical wall through which the material is adapted to descend, each second conveyor means being a screw in each interior chamber for elevating the material, at least one of said conveyor units being externally encircled by the remainder of said conveyor units, means for locating said conveyor units in said last-mentioned spatial relationship to each other, said locating means being a plurality of complementary male and female locating elements carried one by each of said conveyor units and the remainder by said base supporting means, and a plurality of individual gamma ray sources disposed in generally exterior encircling relationship to said one conveyor unit and generally exteriorly and inboard of the remainder of said conveyor units, and the remainder of said locating elements are positioned in a generally symmetrical pattern upon said base support means.

79. A modular irradiator comprising a substantially self-contained conveyor unit, means for conveying material to be irradiated through said conveyor unit, gamma ray source means for subjecting the conveyed material to gamma rays, said gamma ray source means being disposed in an irradiation zone in exterior surrounding relationship to said conveyor unit, means for elevating said conveyor unit upwardly and outwardly from within said surrounding gamma ray source means and said irradiation zone, said conveyor unit includes a chamber defined by a generally cylindrical wall, said conveyor means includes first conveyor means for directing material generally downwardly of said cylindrical wall and second conveyor means for directing material generally upwardly of said cylindrical wall, and said first conveyor means includes a pair of relatively telescopic tubes mounted for relative sliding to effect upward elevation of said conveyor unit beyond said irradiation zone.

80. The modular irradiator as defined in claim 79 wherein one of said tubes is positioned at least partially within said cylindrical wall, said one tube having an outlet for delivering material into said chamber, said one tube having means for defining a material elevating screw, and means for rotating said one tube to elevate material in said chamber.

81. The modular irradiator as defined in claim 79 wherein said tubes are capable of being telescopically retracted a distance corresponding to the distance said cylindrical wall is positioned within said irradiation zone such that said conveyor unit can be totally withdrawn from said irradiation zone by virtue of the relative retracting telescoping motion of said tubes.

82. The modular irradiator as defined in claim 79 wherein one of said pair of tubes is positioned at least partially within said cylindrical wall and has an outlet opening into said chamber.

83. The modular irradiator as defined in claim 82 wherein said one tube includes a screw defining said second conveyor means for elevating the material through said chamber, and means for rotating said one tube.

84. The modular irradiator as defined in claim 83 wherein said tubes are capable of being telescopically retracted a distance corresponding to the distance said cylindrical wall is positioned within said irradiation zone such that said conveyor unit can be totally withdrawn from said irradiation zone by virtue of the relative retracting telescoping motion of said tubes.

85. The modular irradiator as defined in claim 80 wherein said rotating means include a worm and gear drive mechanism.

86. An irradiator for irradiating material comprising a generally upright cylindrical wall defining an interior chamber, first conveyor means for directing granular bulk material generally downwardly of said cylindrical wall, second conveyor means for directing the granular bulk material generally upwardly and interiorly of said cylindrical wall, third conveyor means for conveying palletized material around the exterior of said cylindrical wall, means for subjecting the conveyed material to gamma rays during the movement thereof by at least one of said first, second and third conveying means, said third conveyor means being a spiral conveyor, and means for elevating and lowering said cylindrical wall relative to an irradiation zone defined by said gamma ray source means when the latter is in an irradiation position thereof.

87. The irradiator as defined in claim 86 including means for elevating and lowering said gamma ray source means relative said irradiation zone.

88. The irradiator as defined in claim 86 wherein said spiral conveyor includes a downwardly directed spiral path of travel and an upwardly directed spiral path of travel.

89. The irradiator as defined in claim 86 wherein said spiral conveyor includes a downwardly directed spiral path of travel and an upwardly directed spiral path of travel, and said downwardly and upwardly directed spiral paths of travel are radially and axially offset from each other.

90. The irradiator as defined in claim 80 wherein said spiral conveyor includes a downwardly directed spiral path of travel and an upwardly directed spiral path of travel, said downwardly and upwardly directed spiral paths of travel are radially and axially offset from each other, and said spiral paths have generally coincident axes.

91. An irradiator for irradiating bulk material comprising a plurality of generally upright cylindrical walls each defining an interior chamber, first conveyor means for directing granular bulk material to be irradiated generally downwardly of each of said cylindrical walls, second conveyor means for directing the granular bulk material generally upwardly and interiorly of each of said cylindrical walls, a first of said cylindrical walls being circumferentially exteriorly surrounded by a plurality of circumferentially disposed gamma ray source means for subjecting the material conveyed through the interior chamber of said first cylindrical wall to gamma rays, and the remainder of said cylindrical walls being in external circumferential surrounding relationship to said plurality of circumferentially disposed gamma ray source means such that the material conveyed through the interior chambers of said remainder of cylindrical walls is subject to gamma rays of said gamma ray source means.

92. The irradiator as defined in claim 91 wherein said gamma ray source means is formed by a plurality of racks each carrying a plurality of individual gamma ray source elements.

93. The irradiator as defined in claim 91 wherein said gamma ray source means is formed by a plurality of individual tubular housings each housing a plurality of individual stacked gamma ray source elements.

94. The irradiator as defined in claim 91 including means for positioning and removably locating said cylindrical walls relative to each other.

95. The irradiator as defined in claim 91 including means for positioning and removably locating said plurality of gamma ray source means relative to each other.

96. The irradiator as defined in claim 91 including means for positioning and removably locating said cylindrical walls relative to each other, and means for positioning and removably locating said plurality of gamma ray source means relative to each other.

97. The irradiator as defined in claim 91 including means for positioning and removably locating said cylindrical walls relative to each other, and means for positioning and removably locating said plurality of gamma ray source means relative to each other and relative to said cylindrical walls.

98. The irradiator as defined in claim 94 wherein said positioning and locating means include complementary male and female locating elements.

99. The irradiator as defined in claim 95 wherein said positioning and locating means include complementary male and female locating elements.

100. The irradiator as defined in claim 96 wherein said positioning and locating means include complementary male and female locating elements.

101. A method of irradiating bulk granular material comprising the steps of transporting bulk granular material in a first direction along a first path of travel, thereafter transporting the bulk granular material in a second direction opposite to said first direction along a second path of travel, irradiating the bulk granular material by gamma rays from a source disposed lengthwise along and generally parallel to said first and second paths of travel, and eccentrically repositioning at least one of the first and second paths of travel relative to the gamma ray source to vary the relative positions thereof.

102. The irradiating method as defined in claim 101 including the step of eccentrically repositioning at least one of the first and second paths of travel and the gamma ray source relative to each other to vary the relative positions thereof.

103. The irradiating method as defined in claim 102 wherein the first direction is downward, the second direction is upward, and the second path of travel is spiral.

104. The irradiating method as defined in claim 102 wherein the irradiating step is performed by directing gamma rays radially inwardly from the source which is also disposed in exterior surrounding relationship to both the first and second paths of travel.

105. The irradiating method as defined in claim 102 including the step of transporting palletized material along a third path of travel exteriorly of and in generally surrounding relationship to the gamma ray source.

106. The irradiating method as defined in claim 102 including the step of transporting material along a third path of travel exteriorly of the gamma ray source and in generally parallel relationship to the first and second paths of travel.

107. The irradiating method as defined in claim 102 including the step of transporting material along a plurality of groups of third and fourth paths of travel exteriorly circumferentially surrounding the gamma ray source and in generally parallel relationship to the first and second paths of travel.

108. The irradiating method as defined in claim 102 wherein the first direction is downward, the second diraction is upward and the first path of travel is disposed entirely within the second path of travel.

109. The irradiating method as defined in claim 101 wherein the first direction is downward, the second direction is upward, and the second path of travel is spiral.

110. The irradiating method as defined in claim 109 including the step of transporting material along a third path of travel exteriorly of the gamma ray source, and the third path of travel is spiral.

111. The irradiating method as defined in claim 109 including the step of transporting material along a path of travel exteriorly of the gamma ray source, and the third path of travel is spiral and in a third direction, identical to said first direction.

112. The irradiating method as defined in claim 109 including the step of transporting material along a third path of travel exteriorly of the gamma ray source, and the third path of travel is spiral and in third and fourth directions identical to said first and second directions.

113. The irradiating method as defined in claim 109 wherein said second path of travel completely surrounds said first path of travel.

114. The irradiating method as defined in claim 101 wherein the irradiating step is performed by directing gamma rays radially inwardly from the source which is also disposed in exterior surrounding relationship to both the first and second paths of travel.

115. The irradiating method as defined in claim 101 including the step of transporting palletized material along a third path of travel exteriorly of and in generally surrounding relationship to the gamma ray source.

116. The irradiating method as defined in claim 101 including the step of transporting material along a third path of travel exteriorly of the gamma ray source and in generally parallel relationship to the first and second paths of travel.

117. The irradiating method as defined in claim 101 including the step of transporting material along a plurality of groups of third and fourth paths of travel exteriorly circumferentially surrounding the gamma ray source and in generally parallel relationship to the first and second paths of travel.

118. The irradiating method as defined in claim 101 wherein the first direction is downward, the second direction is upward and the first path of travel is disposed entirely within the second path of travel.

119. The irradiating method as defined in claim 101 wherein the first direction is downward, the second direction is upward, and rotating the second path of travel to move the material in the second direction.

120. The irradiating method as defined in claim 101 including the step of disposing the gamma ray source in exterior circumferential surrounding relationship to the first and second paths of travel, and transporting material along a third path of travel exteriorly of the gamma ray source.

121. The irradiating method as defined in claim 101 including the step of positioning the gamma ray source in generally exterior circumferentially surrounding relationship to the first and second paths of travel positioning palletized materially radially outboard of the gamma ray source at several positions disposed circumferentially thereabout, and selectively radially moving and rotating the palletized material to expose different peripheral exterior surfaces thereof to the gamma rays.

122. A method of irradiating bulk granular material comprising the steps of transporting bulk granular material in a first direction along a first path of travel, thereafter transporting the bulk granular material in a second direction opposite to said first direction along a second path of travel, irradiating the bulk granular material by gamma rays from a source disposed lengthwise along and generally parallel to said first and second paths of travel, and eccentrically rotating the gamma ray source relative to at least one of the first and second paths of travel to vary the relative positions thereof.

123. The irradiating method as defined in claim 122 wherein the first direction is downward, the second direction is upward, and the second path of travel is spiral.

124. The irradiating method as defined in claim 122 wherein the irradiating step is performed by directing gamma rays radially inwardly from the source which is also disposed in exterior surrounding relationship to both the first and second paths of travel.

125. The irradiating method as defined in claim 122 including the step of transporting palletized material along a third path of travel exteriorly of and in generally surrounding relationship to the gamma ray source.

126. The irradiating method as defined in claim 122 including the step of transporting material along a third path of travel exteriorly of the gamma ray source and in generally parallel relationship to the first and second paths of travel.

127. The irradiating method as defined in claim 122 including the step of transporting material along a plurality of groups of third and fourth paths of travel exteriorly circumferentially surrounding the gamma ray source and in generally parallel relationship to the first and second paths of travel.

* * * * *